US011155373B2

(12) United States Patent
Melrose

(10) Patent No.: US 11,155,373 B2
(45) Date of Patent: Oct. 26, 2021

(54) HEADSPACE MODIFICATION METHOD FOR REMOVAL OF VACUUM PRESSURE AND APPARATUS THEREFOR

(71) Applicant: David Murray Melrose, Mt. Eden (NZ)

(72) Inventor: David Murray Melrose, Mt. Eden (NZ)

( * ) Notice: Subject to any disclaimer, the term of this patent is extended or adjusted under 35 U.S.C. 154(b) by 255 days.

(21) Appl. No.: 15/345,306

(22) Filed: Nov. 7, 2016

(65) Prior Publication Data

US 2017/0305581 A1 Oct. 26, 2017

Related U.S. Application Data

(63) Continuation of application No. 12/993,253, filed as application No. PCT/NZ2009/000079 on May 18, 2009, now abandoned.

(30) Foreign Application Priority Data

May 19, 2008 (NZ) ..... 568439
Dec. 19, 2008 (NZ) ..... 573865

(51) Int. Cl.

| | |
|---|---|
| ***B65B 7/28*** | (2006.01) |
| ***B65B 31/00*** | (2006.01) |
| ***B65B 31/06*** | (2006.01) |
| ***B65D 47/24*** | (2006.01) |
| ***B65D 47/30*** | (2006.01) |

(Continued)

(52) U.S. Cl.

CPC ..... *B65B 7/2842* (2013.01); *B65B 7/2807* (2013.01); *B65B 31/006* (2013.01); *B65B 31/06* (2013.01); *B65D 47/243* (2013.01); *B65D 47/30* (2013.01); *B65D 79/005* (2013.01); *B67C 2003/226* (2013.01)

(58) Field of Classification Search

CPC ... B65B 7/2842; B65B 7/2807; B65B 31/006; B65B 31/06; B65D 47/243; B65D 47/30; B65D 79/005; B67C 2003/226

USPC ..... 53/440

See application file for complete search history.

(56) References Cited

U.S. PATENT DOCUMENTS

| | | | |
|---|---|---|---|
| 1,027,597 | A | 5/1912 | Dor-Delattre |
| 1,150,992 | A | 8/1915 | Buhles |

(Continued)

FOREIGN PATENT DOCUMENTS

| | | |
|---|---|---|
| CN | 2341917 Y | 10/1999 |
| DE | 1183108 | 12/1964 |

(Continued)

OTHER PUBLICATIONS

U.S. Appl. No. 10/598,544, Melrose File History.

(Continued)

*Primary Examiner* — Sameh Tawfik

(74) *Attorney, Agent, or Firm* — Rothwell, Figg, Ernst & Manbeck, P.C.

(57) ABSTRACT

To modify the headspace in a container to remove vacuum pressure, a container has a seal or cap which may provide a temporary opening into the container which is sealable under compression to provide a controlled raising of the internal pressure as the heated contents of the container cools. A sealing chamber (84) may enable the introduction of a fluid into the headspace (23*b*) to force the fluid level (40) lower. Other methods and apparatus are described.

17 Claims, 33 Drawing Sheets

(51) Int. Cl.
*B65D 79/00* (2006.01)
*B67C 3/22* (2006.01)

(56) References Cited

U.S. PATENT DOCUMENTS 1,676,846 A 7/1928 Watson
1,703,457 A 2/1929 Robertson
1,748,961 A 3/1930 Risser
1,839,918 A 1/1932 Gustafson
1,908,003 A 5/1933 Williams
1,913,177 A 6/1933 Underwood
1,920,240 A 8/1933 Brady
2,436,849 A 3/1948 Billetter
2,551,937 A 5/1951 Gallagher
2,842,916 A 7/1958 Parodi
2,974,456 A 3/1961 Parodi
2,997,397 A * 8/1961 Alcibiade ..... B65D 51/16 215/233
3,057,537 A 10/1962 Pollick
3,228,169 A 1/1966 Brown
3,350,839 A * 11/1967 Carter ..... B67B 3/24 53/510
3,517,616 A 6/1970 Graham
3,807,133 A * 4/1974 Simonazzi ..... B67B 3/064 198/383
4,040,233 A * 8/1977 Valyi ..... B29C 49/221 53/440
4,174,784 A 11/1979 Hartung
4,424,659 A 1/1984 Perigo et al.
4,459,843 A * 7/1984 Durham ..... G01M 3/3236 73/37
4,514,953 A 5/1985 Patzwahl
4,557,398 A 12/1985 Hambleton et al.
4,602,473 A 7/1986 Hayashi et al.
4,655,029 A * 4/1987 Weiss ..... B67C 3/10 141/6
4,662,154 A 5/1987 Hayward
4,689,936 A * 9/1987 Gaikema ..... B29C 67/004 426/118
4,729,204 A * 3/1988 Weiss ..... B65B 31/00 53/88
4,747,497 A 5/1988 Holman
4,765,119 A 8/1988 Aidlin et al.
4,768,665 A * 9/1988 Ballas ..... B65B 31/047 215/228
4,793,475 A 12/1988 Itzel
4,838,324 A 6/1989 Boyd
4,840,014 A 6/1989 Takehana et al.
4,848,419 A 7/1989 Damen
5,033,254 A * 7/1991 Zenger ..... B65B 31/006 53/431
5,071,667 A 12/1991 Grűne et al.
5,103,990 A 4/1992 Irwin
5,240,131 A 8/1993 Keller
5,251,424 A 10/1993 Zenger et al.
5,433,331 A 7/1995 Morini
5,458,252 A 10/1995 Logel
5,641,004 A 7/1997 Py
5,802,812 A * 9/1998 Heudecker ..... B67C 3/222 53/287
5,901,867 A * 5/1999 Mattson ..... B65D 51/1616 215/261
5,908,128 A 6/1999 Krishnakumar et al.
6,076,334 A 6/2000 Kitahora et al.
6,105,760 A 8/2000 Mollstam et al.
6,164,470 A 12/2000 Chino
6,189,293 B1 * 2/2001 Kraft ..... B65G 47/32 53/440
6,230,472 B1 * 5/2001 Stahlecker ..... A61L 2/14 53/331.5
6,274,209 B1 8/2001 Pagidas et al.
6,279,787 B1 * 8/2001 Kim ..... B67D 1/0425 222/401
6,279,789 B1 8/2001 Krall
6,364,152 B1 4/2002 Poslinski
6,508,375 B1 1/2003 Krall
6,523,330 B1 2/2003 Hurd
6,688,081 B2 2/2004 Boyd
6,694,709 B2 2/2004 Takahashi et al.
6,983,857 B2 1/2006 Miller et al.
7,077,176 B2 7/2006 Py
7,121,062 B2 * 10/2006 Till ..... B67C 7/0086 53/167
7,219,480 B2 5/2007 Winters et al.
7,232,046 B1 * 6/2007 Stassi ..... B67D 1/0425 141/64
7,347,032 B2 3/2008 Cirio
7,621,412 B2 11/2009 Raniwala
2002/0056695 A1 5/2002 Boulange et al.
2003/0110736 A1 6/2003 Boyd
2004/0265447 A1 12/2004 Raniwala
2005/0028487 A1 2/2005 Winters et al.
2011/0131933 A1 6/2011 Livingston
2012/0205339 A1 8/2012 Bobrov et al.
2012/0311966 A1 12/2012 Melrose
2013/0055679 A1 3/2013 Melrose

FOREIGN PATENT DOCUMENTS

DE 4036421 5/1992
DE 19538023 4/1996
DE 19624586 1/1998
DE 29719203 1/1999
EP 0 208 352 1/1987
EP 0208352 1/1987
EP 0 357 276 3/1990
EP 0357276 3/1990
EP 0701966 3/1996
FR 1 389 226 2/1965
FR 1389226 2/1965
FR 2 630 408 10/1989
FR 2630408 10/1989
FR 2704516 11/1994
FR 2780948 11/2000
GB 1027597 4/1966
GB 1561143 2/1980
GB 2050319 1/1981
GB 2271347 4/1994
GB 2271347 A 4/1994
JP S56113515 A 9/1981
JP S56113515 A 9/1981
JP 57117350 7/1982
JP 8-25591 1/1989
JP 57117350 7/1992
JP 8156961 6/1996
WO WO 94/25347 11/1994
WO WO 00/21837 4/2000
WO WO 00/30491 6/2000
WO WO 02/18213 3/2002
WO WO 04/028910 4/2004
WO WO 05/47760 5/2005
WO WO 2005/085082 9/2005
WO WO 06/53013 5/2006
WO WO 2009/142510 11/2009

OTHER PUBLICATIONS

U.S. Appl. No. 12/639,903, Melrose File History.
U.S. Appl. No. 13/195,867, Melrose File History.
U.S. Appl. No. 14/722,086, Melrose File History.
U.S. Appl. No. 13/797,282, Melrose File History.
U.S. Appl. No. 13/797,369, Melrose File History.
USPTO, File History for U.S. Appl. No. 13/510,881, filed May 18, 2012, published Dec. 13, 2012, as US20120311966.
Garlati, Timea, European Search Report, EP09750830, dated Dec. 19, 2014, 8 pages.
CR 2006/8227, Search Report, dated Jan. 24, 2007, Costa Rica patent application of Bernard Winters et al.
State Service of Intellectual Property of Ukraine, Office Action for Application No. 201015264, dated Jun. 12, 2014, 5 pages.
Hong Yu, WIPO Search Report for WO2009/142510, dated Jul. 29, 2009, pp. 1-4, WIPO Australian Patent Office.

(56) References Cited

OTHER PUBLICATIONS

WIPO International Search Report, WO2005/085082, dated Sep. 15, 2005.
Concise Oxford English Dictionary, 10th Edition, 1999, cover and p. 295.
John Lackie, Editor, Chambers Dictionary of Science and Technology, Chambers publisher, 2007, cover and p. 257.
WIPO International Search Report, WO2009/142510, dated Nov. 26, 2009.
Japan Office Action (Translation) from JP2007-501742, dated Aug. 24, 2010.
English translation of Japan Patent Office Office Action dated Aug. 24, 2010 for JP2007-501742, 2 pages.
Giacobetti, Adriano, Int'l Search Report, WO2005/085082, dated May 27, 2005, 3 pages, ISA/Australian Patent Office.
Hong Yu, WIPO Search Report for WO2009/14251, dated Jul. 29, 2009, pp. 1-4, WIPO Australian Patent Office.
File History for U.S. Appl. No. 12/947,124, filed Nov. 16, 2010, published Jun. 9, 2011, as US20110131933.
File History for U.S. Appl. No. 13/603,324, filed Sep. 4, 2012, published Mar. 7, 2013, as US20130055679.
English translation of Japan Patent Office Action dated Aug. 24, 2010 for JP2007-501742, 2 pages.

* cited by examiner

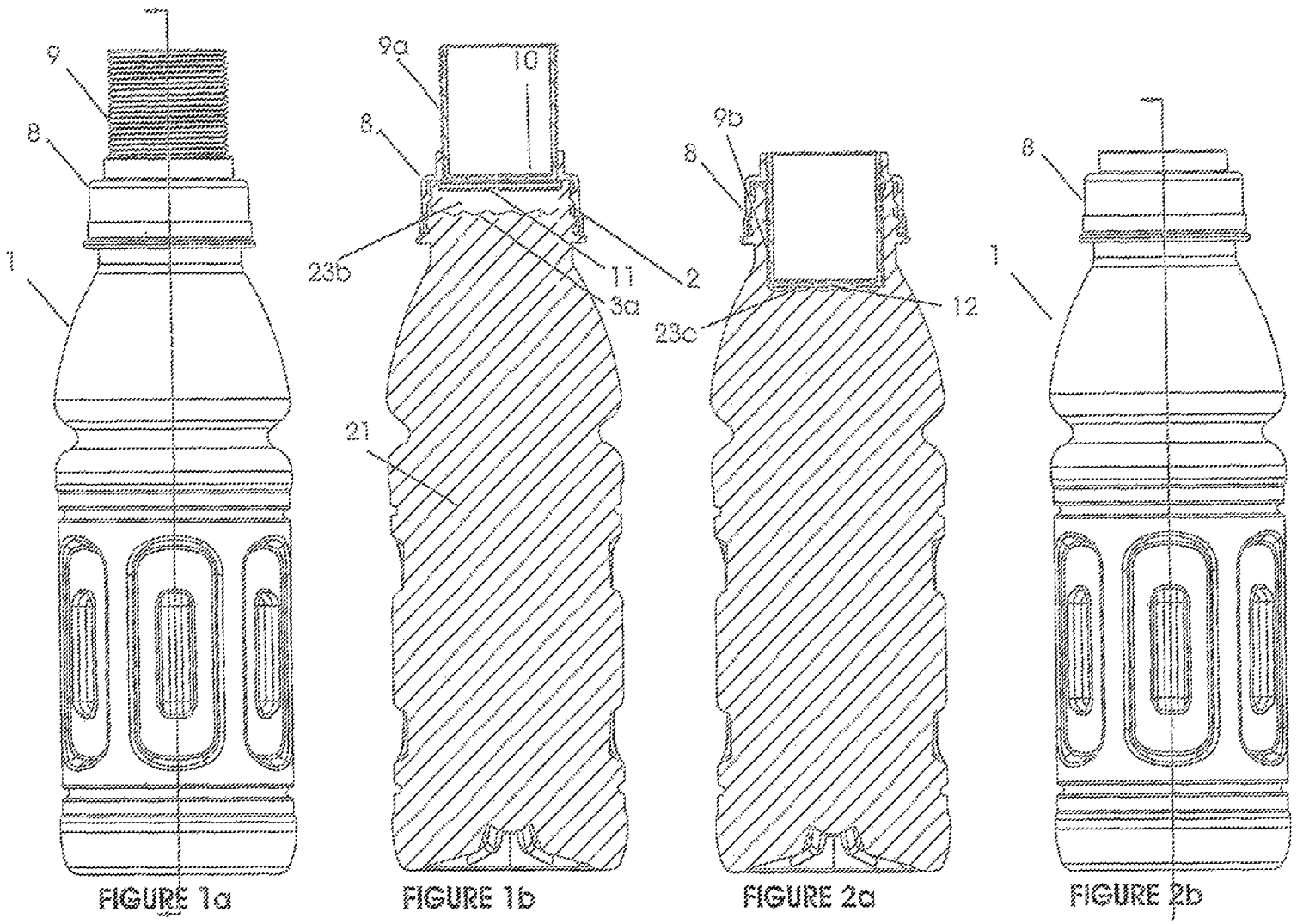
PRIOR ART

STEP ONE

Bottle Capped

STEP TWO

Bottle Pressurized

STEP THREE

Cap sealed/Ball closed to maintain pressure

STEP ONE

Bottle Capped

STEP TWO

Bottle Pressurized

STEP THREE

Cap sealed/Push closed to maintain pressure

HEADSPACE MODIFICATION METHOD FOR REMOVAL OF VACUUM PRESSURE AND APPARATUS THEREFOR

CROSS REFERENCE TO RELATED APPLICATIONS

This application is a continuation of U.S. Ser. No. 12/993,253, filed Nov. 17, 2010, published as US2011/0094618 on Apr. 28, 2011, which is a PCT National Stage Section 371 of PCT/NZ 2009/000079, filed May 18, 2009, published Nov. 26, 2009 as WO 2009/142510, which claims priority to NZ568439 filed May 19, 2008, and to NZ573865 filed Dec. 19, 2008. The entire contents of all of the foregoing applications and their publications are incorporated herein by reference.

TECHNICAL FIELD OF THE INVENTION

This invention relates generally to a method of lightweighting hot fill containers by modifying the headspace for the removal of vacuum pressure and apparatus therefor. This is achieved by filling a container with a heated fluid; which term for the purposes of this specification including both liquids and gases unless specified otherwise, sealing the contents of the container from contamination from outside air, and adjusting the pressure of the headspace during the capping process to negate vacuum forces generated within the container following fluid cooling. The headspace modification process displaces the fluid below the headspace in the upper neck region of the container downwardly prior to allowing the fluid contents to cool, and labelling the container. This invention further relates to hot-filled and pasteurized products packaged in heat-set polyester containers and is particularly useful for packaging oxygen sensitive foods and beverages where a longer shelf life is desirable.

BACKGROUND

So called 'hot fill' containers are well known in prior art, whereby manufacturers supply PET containers for various liquids which are filled into the containers and the liquid product is at an elevated temperature, typically at or around 85 degrees C. (185 degrees F.).

The container is manufactured to withstand the thermal shock of holding a heated liquid, resulting in a 'heat-set' plastic container. This thermal shock is a result of either introducing the liquid hot at filling, or heating the liquid after it is introduced into the container.

Once the liquid cools down in a capped container, however, the volume of the liquid in the container reduces, creating a vacuum within the container. This liquid shrinkage results in vacuum pressures that pull inwardly on the side and end walls of the container. This in turn leads to deformation in the walls of plastic bottles if they are not constructed rigidly enough to resist such force.

Typically, vacuum pressures have been accommodated by the use of vacuum panels, which distort inwardly under vacuum pressure. Prior art reveals many vertically oriented vacuum panels that allow containers to withstand the rigors of a hot fill procedure. Such vertically oriented vacuum panels generally lie parallel to the longitudinal axis of a container and flex inwardly under vacuum pressure toward this longitudinal axis.

In addition to the vertically oriented vacuum panels, many prior art containers also have flexible base regions to provide additional vacuum compensation. Many prior art containers designed for hot-filling have various modifications to their end-walls, or base regions to allow for as much inward flexure as possible to accommodate at least some of the vacuum pressure generated within the container.

Even with such substantial displacement of vacuum panels, however, the container requires further strengthening to prevent distortion under the vacuum force.

The liquid shrinkage derived from liquid cooling, causes a build up of vacuum pressure. Vacuum panels deflect toward this negative pressure, to a degree lessening the vacuum force, by effectively creating a smaller container to better accommodate the smaller volume of contents. However, this smaller shape is held in place by the generating vacuum force. The more difficult the structure is to deflect inwardly, the more vacuum force will be generated. In prior art proposals, a substantial amount of vacuum may still be present in the container and this tends to distort the overall shape unless a large, annular strengthening ring is provided in horizontal, or transverse, orientation typically at least a ⅓ of the distance from an end to the container.

The present invention relates to hot-fill containers and may be used by way of example in conjunction with the hot fill containers described in international applications published under numbers WO 02/18213 and WO 2004/028910 (PCT specifications) which specifications are also incorporated herein in their entirety where appropriate.

The PCT specifications background the design of hot-fill containers and the problems with such designs that were to be overcome or at least ameliorated.

A problem exists when locating such transversely oriented panels in the container side-wall, or end-wall or base region, even after vacuum is removed completely from the container when the liquid cools down and the panel is inverted. The container exits the filling line just above a typical ambient temperature, and the panel is inverted to achieve an ambient pressure within the container, as opposed to negative pressure as found in prior art. The container is labelled and often refrigerated at point of sale.

This refrigeration provides further product contraction and in containers with very little sidewall structure, so-called 'glass look-a-like' bottles, there may therefore be some paneling that occurs on the containers that is unsightly. To overcome this, an attempt is made to provide the base transverse panel with more extraction potential than is required, so that it may be forced into inversion against the force of the small headspace present during filling. This creates a small positive pressure at fill time, and this positive pressure provides some relief to the situation. As further cool down occurs, for example during refrigeration, the positive pressure may drop and may provide for an ambient pressure at refrigerated temperatures, and so avoid paneling in the container.

This situation is very hard to engineer successfully, however, as it depends on utilising a larger headspace in order to compress at base inversion time, and it is less desirable to introduce a larger headspace to the container than is necessary in order to retain product quality.

While it is desirable to have the liquid level in the container drop, to avoid spill when opened by the consumer, it has been found that providing too much positive pressure potential within the base may cause some product spill when the container is opened, particularly if at ambient temperatures.

In most filling operations, containers are generally filled to a level just below the container's highest level, at the top of the neck finish.

Maintaining as small a container headspace as possible is desirable in order to provide a tolerance for subtle differences in product density or container capacity, to minimize waste from spillage and overflow of liquids on a high-speed package filling line, and to reduce container contraction from cooling contents after hot fill.

Headspace contains gases that in time can damage some products or place extra demands on container structural integrity. Examples include products sensitive to oxygen and products filled and sealed at elevated temperatures.

Filling and sealing a rigid container at elevated temperatures can create significant vacuum forces when excessive headspace gas is also present.

Accordingly, less headspace gas is desirable with containers filled at elevated temperatures, to reduce vacuum forces acting on the container that could compromise structural integrity, induce container stresses, or significantly distort container shape. This is also true during pasteurization and retort processes, which involve filling the container first, sealing, and then subjecting the package to elevated temperatures for a sustained period.

Those skilled in the art are aware of several container manufacturing heat-set processes for improving package heat-resistant performance. In the case of the polyester, polyethylene terephthalate, for example, the heat-setting process generally involves relieving stresses created in the container during its manufacture and to improve crystalline structure.

Typically, a polyethylene terephthalate container intended for a cold-fill carbonated beverage has higher internal stresses and less crystalline molecular structure than a container intended for a hot-fill, pasteurized, or retort product application. However, even with containers such as described in the abovementioned PCT specifications where there is little residual vacuum pressure, the neck finish of the container is still required to be very thick in order to withstand the temperature of fill.

My PCT patent specification WO 2005/085082 describes a previous proposal for a headspace displacement method which is incorporated herein in its entirety where appropriate by way of reference.

Where reference in this specification is made to any prior art this is not an acknowledgment that it forms part of the common general knowledge in any country or region.

OBJECTS OF THE INVENTION

In view of the above, it is an object of one possible embodiment of the present invention to provide a headspace sealing and modification method that can provide for removal of vacuum pressure such that there is substantially no remaining force within the container.

It is a further object of one possible embodiment of the present invention to provide a headspace compression method whereby air, or some other gas or liquid or combination thereof, is charged into the headspace under sealed pressure to create an increased pressure in order to negate the effect of vacuum pressure created during cooling of the product.

It is a further object of one possible embodiment of the present invention to provide a headspace modification method whereby sterile or heated liquid, or air, or some other gas or combination thereof, is charged into the headspace under sterile conditions to create a positive pressure in order to negate the effect of vacuum pressure created during cooling of the product.

It is a further object of one possible embodiment of the present invention to provide a headspace modification method whereby sterile air, or some other gas or liquid or combination thereof, is charged into the headspace under sealed pressure to negate the effect of vacuum pressure created during cooling of the product.

It is a further object of one possible embodiment of the present invention to provide a headspace modification method whereby a compressive seal is applied to the neck finish of the container.

It is a further object of one possible embodiment of the present invention to provide a headspace displacement method whereby a compressive seal is applied to the neck finish that is forcibly displaceable into the container prior to cooling the liquid contents, such that a positive pressure may be induced into the container.

A further and alternative object of the present invention in all its embodiments, all the objects to be read disjunctively, is to at least provide the public with a useful choice.

SUMMARY OF THE INVENTION

According to one aspect of the present invention there is provided a container having a seal or cap including, or adapted to provide, an opening or aperture into said container, said aperture providing for the introduction under pressure of at least one fluid, said opening or aperture also being sealable to provide a controlled raising of internal pressure within the container prior to cooling of heated contents within the container.

According to a further aspect of the present invention there is provided a container having a seal or cap temporarily applied such that an opening or aperture into said container is provided by an incomplete seal being formed between the cap and a neck finish of the container, said opening or aperture providing for the introduction under pressure of at least one fluid, said opening or aperture also being sealable under compression to provide a controlled raising of internal pressure within the container prior to cooling of heated contents within the container.

According to a further aspect of the present invention there is provided a container having a seal or cap providing a temporary seal immediately post-filling and having an aperture or opening, said aperture or opening being accessible under substantially sterile conditions to provide for the introduction of at least one heated and/or sterile fluid, said aperture or opening also further being sealable under substantially sterile conditions to provide a controlled raising of internal pressure within the container following cooling of heated contents within the container.

According to a further aspect of the invention a method of filling a container with a fluid includes introducing the fluid through an open end of the container so that it, at least substantially, fills the container, heating the fluid before or after its introduction into the container, providing a seal or cap having an opening or aperture, providing a method of providing at least one fluid through the opening or aperture and sealing the opening or aperture, so as to compensate for subsequent pressure reduction in a headspace of the container under the seal or cap following the cooling of the heated contents.

According to a further aspect of the invention a method of filling a container with a fluid includes introducing the fluid through an open end of the container so that it, at least substantially, fills the container, heating the fluid before or after its introduction into the container, providing a seal or cap having an opening or aperture, said opening or aperture being initially sealed, providing for the heated contents to cool, further providing a method of subsequently accessing the opening or aperture and injecting at least one fluid through the opening or aperture and sealing the aperture, so as to compensate for the pressure reduction in the headspace of the container following the cooling of the heated contents.

According to a further aspect of the present invention there is provided a container having an upper portion with an opening into said container, said upper portion having a neck finish adapted to include, subsequent to the introduction of a heated or heatable liquid into the container, a seal, said seal being inwardly compressible or mechanically moveable before or after the liquid is heated, so as to increase the pressure of the headspace.

According to a further aspect of the invention a method of filling a container with a fluid includes introducing the fluid through an open end of the container so that it, at least substantially, fills the container, heating the fluid before or after its introduction into the container, providing a moveable seal for the open end to cover and contain the fluid, said seal being adapted to compress a headspace of the container so as to compensate for subsequent pressure reduction in the headspace of the container under the seal as the heated contents cool.

According to a further aspect of the invention there is provided a container filling apparatus for filling a container or performing a filling method as defined in the above seven paragraphs.

According to a further aspect there is provided a seal or cap for a container configured for use: with any one of embodiments of the container of the invention or in any one of the embodiments of the method of the invention or with any one of the embodiments of the container filling apparatus of the invention.

According to a further aspect, there is provided a seal or cap for a container including the features of the seal or cap set out in any one of the first three aspects above to the container of the invention.

Further aspects of the invention which should be considered in all its novel aspects will become apparent from the following description.

BRIEF DESCRIPTION OF DRAWINGS

FIG. 1*a* is a side elevation view of an embodiment of a prior art container from WO 2005/085082 with a mechanically compressible cap applied to seal the beverage;

FIG. 1*b* is a cross-sectional view of the embodiment of a prior art container from WO 2005/085082 with a mechanically compressible cap applied to seal the beverage;

FIG. 2*a* is a cross-section view similar to that shown in FIG. 1*b;*

FIG. 2*b* is a side elevation view similar to that shown in FIG. 1*a;*

DETAILED DESCRIPTION OF PREFERRED EMBODIMENTS

Figure 3B:
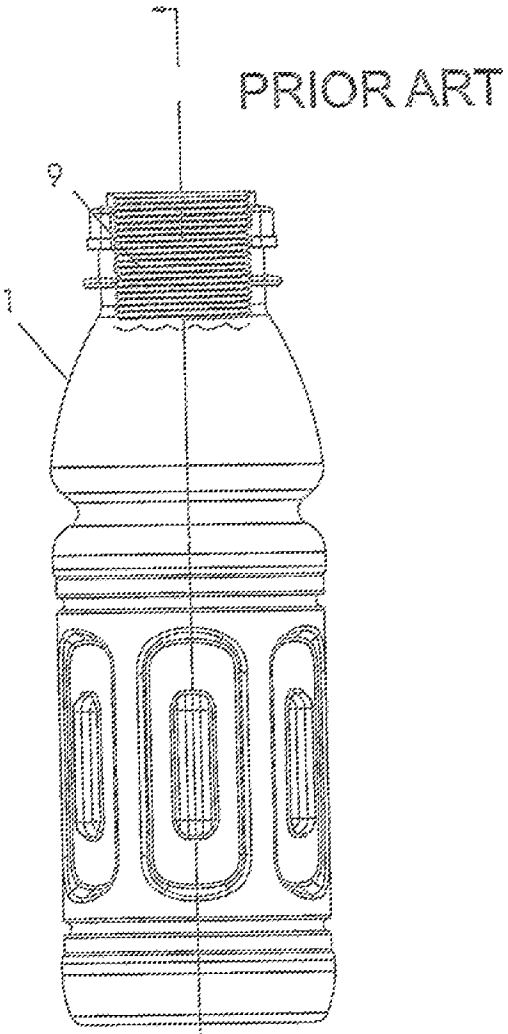
FIG. 3*b* is a side elevation view similar to FIG. 3*a* showing a compressed cap.

The following description of preferred embodiments is merely exemplary in nature, and is in no way intended to limit the invention or its application or uses.

As discussed above, to accommodate vacuum forces during cooling of the contents within a heat set container, containers have typically been provided with a series of vacuum panels around their sidewalls and an optimized base portion. The vacuum panels deform inwardly, and the base deforms upwardly, under the influence of the vacuum forces. This prevents unwanted distortion elsewhere in the container. However, the container is still subjected to internal vacuum force. The panels and base merely provide a suitably resistant structure against that force. The more resistant the structure the more vacuum force will be present. Additionally, end users can feel the vacuum panels when holding the containers.

Typically at a bottling plant the containers will be filled with a hot liquid and then capped before being subjected to a cold-water spray resulting in the formation of a vacuum within the container that the container structure needs to be able to cope with. The present invention relates to hot-fill containers and a method that provides for the substantial removal or substantial negation of vacuum pressure. This allows much greater design freedom and light weighting opportunity as there is no longer any requirement for the structure to be resistant to vacuum forces that would otherwise mechanically distort the container.

As seen in a Prior Art solution in FIGS. 1*a* to *b* and 2*a* to 2*b*, when hot liquid (21) is introduced to a container (1), the liquid occupies a volume that is defined by a first upper level (3*a*). Should a compressive cap (8) be applied immediately post fill to a container neck (2), then a vacuum builds up in the headspace (23*b*) that is above the liquid and under the sealing surface (10) of the compressive cap, the sealing surface being the lower border of the compressible inner chamber (9) which is engaged with the outer portion of the cap (8). This headspace vacuum is normally only released when the cap is removed. While the cap (8) remains in place then the vacuum force remains largely unchanged. If the walls of the container bend or flex inwardly then the vacuum pressure level may drop to a small degree.

Figure 3A:
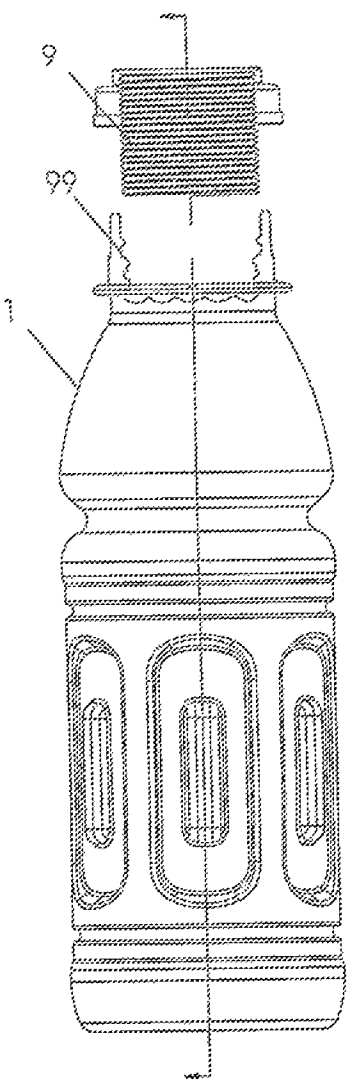
FIG. 3*a* is a side elevation view showing a further prior art use from WO 2005/085082 of a compressed cap of FIGS. 1 and 2.

Referring to FIGS. 3 *a-b* shows a further embodiment of Prior Art invention.

However, as disclosed in the Prior Art, as illustrated in FIGS. 2*a-b*, mechanical compression of the moveable seal within the cap structure to achieve a positive pressure occurs only once the container has cooled. This has the distinct disadvantage of moving unsterilized wall surfaces of the cap components into communication with the liquid contents of the container. This contamination can not be tolerated and so an embodiment of the present invention provides only for this mechanical compression of the headspace to occur immediately post application of the cap.

In this way mechanical compression can achieve a positive pressure while the contents of the container are in a heated state, and to subsequently enable the container to be cooled without paneling. The cap components that enter the container headspace under compression will be sterilised therefore by the heated contents prior to cooling. It will be appreciated that many different structures are envisaged for providing a primary sealing structure that is forcible downwards to displace the liquid contents to a large degree. Containers of the 600 ml size for example will require displacement to the order of 20-30 cc of liquid. Containers of the 2000 ml range of size will require displacement to the order of 70 cc of liquid.

It is envisaged that the cap may be of metal or plastics and could in alternative embodiments be pushed into the neck of the container rather than screwed and could be lockable in a required position.

The cap may be controllably displaced downwardly by any suitable mechanical or electrical or other means, or manually.

The method of the present invention allows many variables in mechanical compression to be accounted for, but for larger containers where significant downward displacement would be required it is envisaged that only some of the compressive force would be obtained from a compressive cap and, more significantly, the remainder would be obtained by the methods discussed in the following disclosure.

Figure 4B:
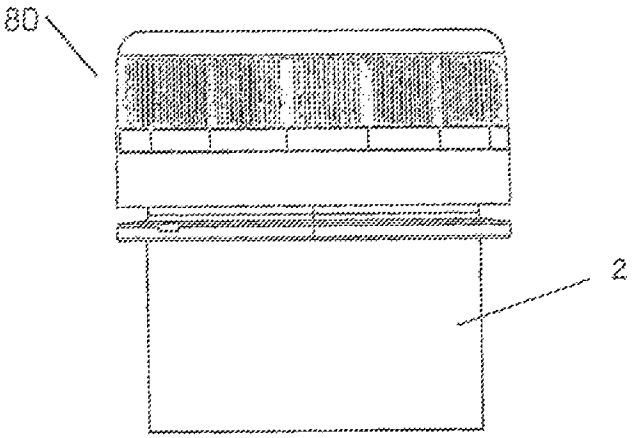
FIG. 4*b* is a side elevation view of a cap according to a possible embodiment of the inventions.
Figure 4A:
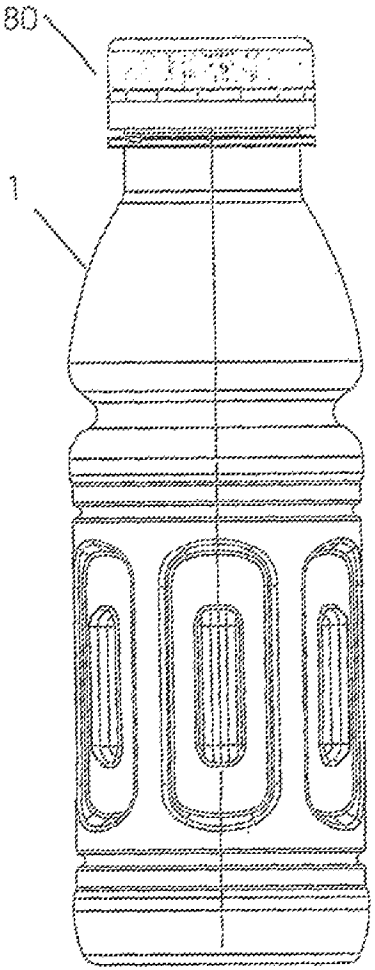
FIG. 4*a* is a side elevation view showing a container and cap according to a possible embodiment of the inventions.

Referring to FIGS. 4*a* and *b*, an exemplary embodiment of the present invention is shown with a cap (80) engaged with the container neck (2). Figures onward from 4*a* all refer to upper portions of containers as similarly shown in FIG. 4*a*.

Figure 5C:
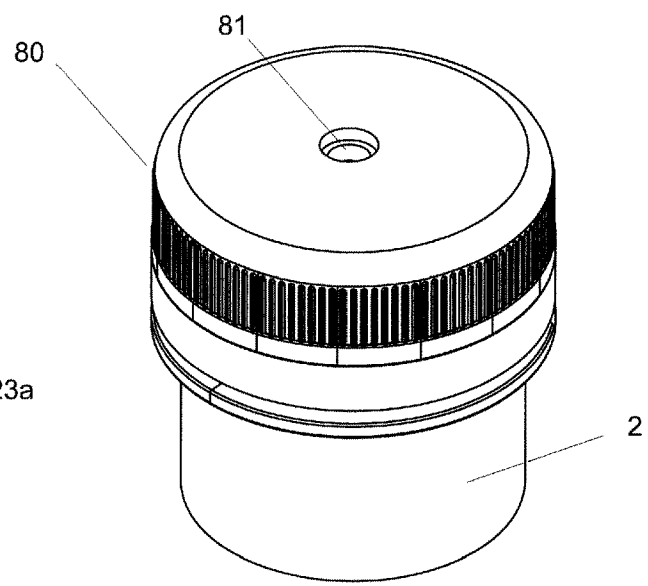
FIG. 5*c* is an upper isometric view of the assembly of FIG. 5*a;*
Figure 5B:
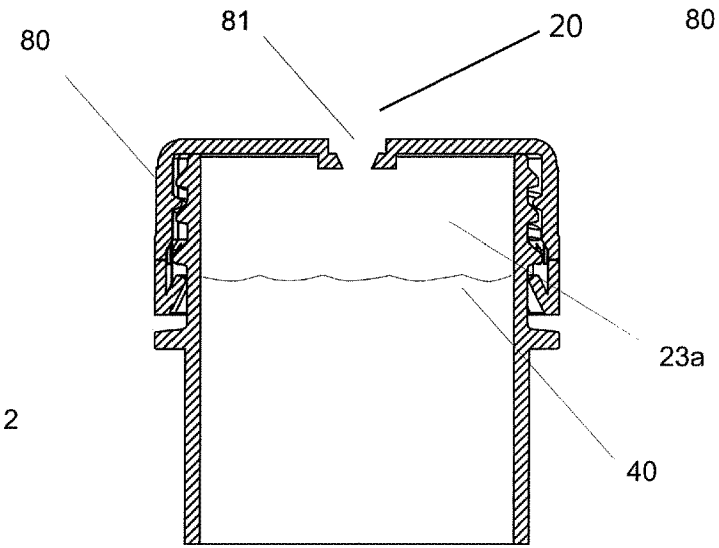
FIG. 5*b* is a longitudinal cross-section of the assembly of FIG. 5*a;*
Figure 5A:
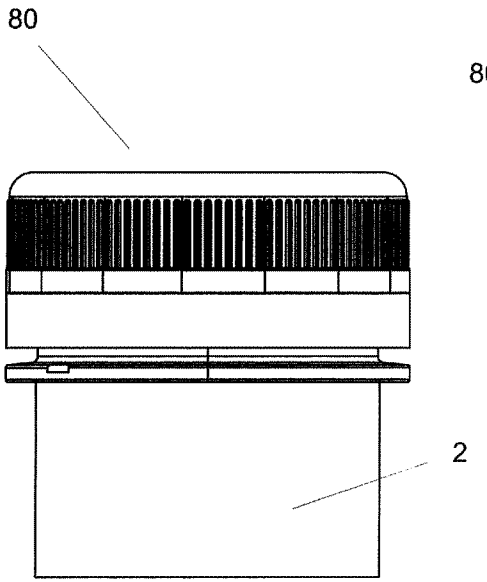
FIG. 5*a* is a side elevation view of a cap according to a possible embodiment of the inventions.

According to a further aspect of the present invention, and referring to FIGS. 4*a* and *b*, and FIGS. 5 *a-c*, following the introduction of a liquid, which may be already heated or suitable for subsequent heating, a cap (80) may be applied to the open end (20), the cap including a small opening or aperture (81). Thus a headspace (23*a*) is contained under the main cap body (80) and above the fluid level (40) in the container. The headspace (23*a*) is communicating with the outside air at this stage and is therefore at ambient pressure and allowing for the fluid level (40).

Figure 6C:
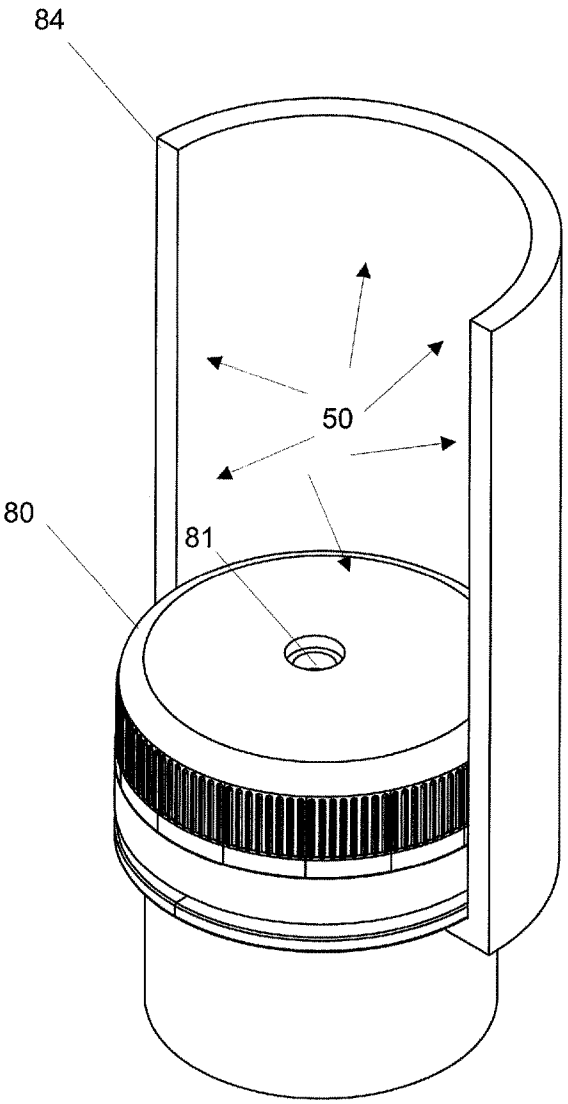
FIG. 6*c* is a schematic and upper isometric view of the assembly shown in FIG. 6*a;*
Figure 6B:
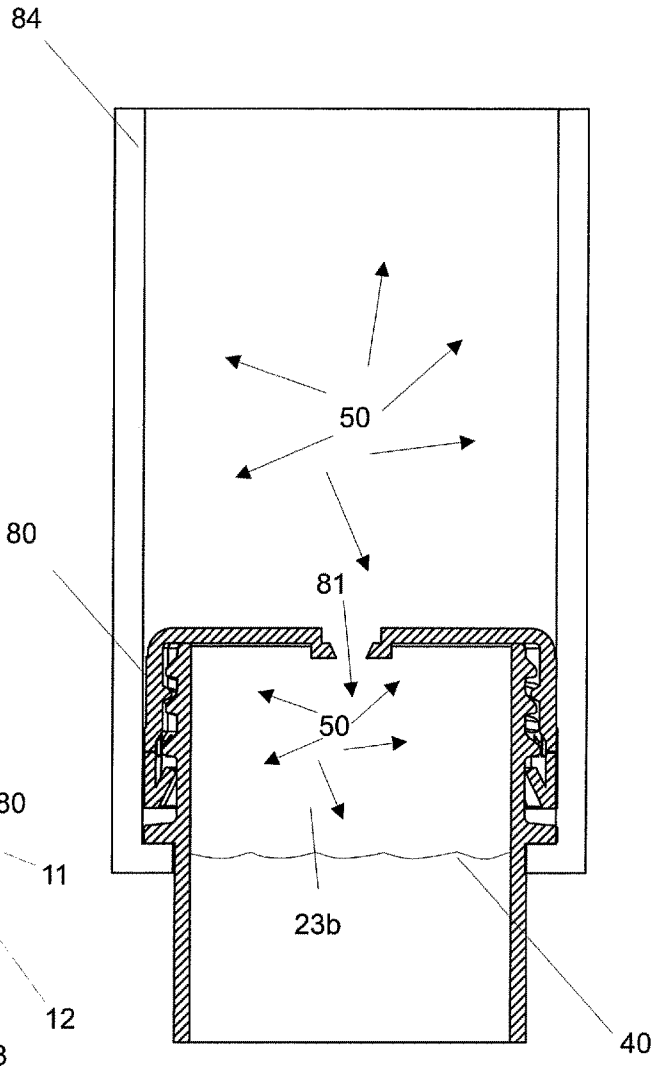
FIG. 6*b* is a schematic and cross-section of the assembly shown in FIG. 6*a;*
Figure 6A:
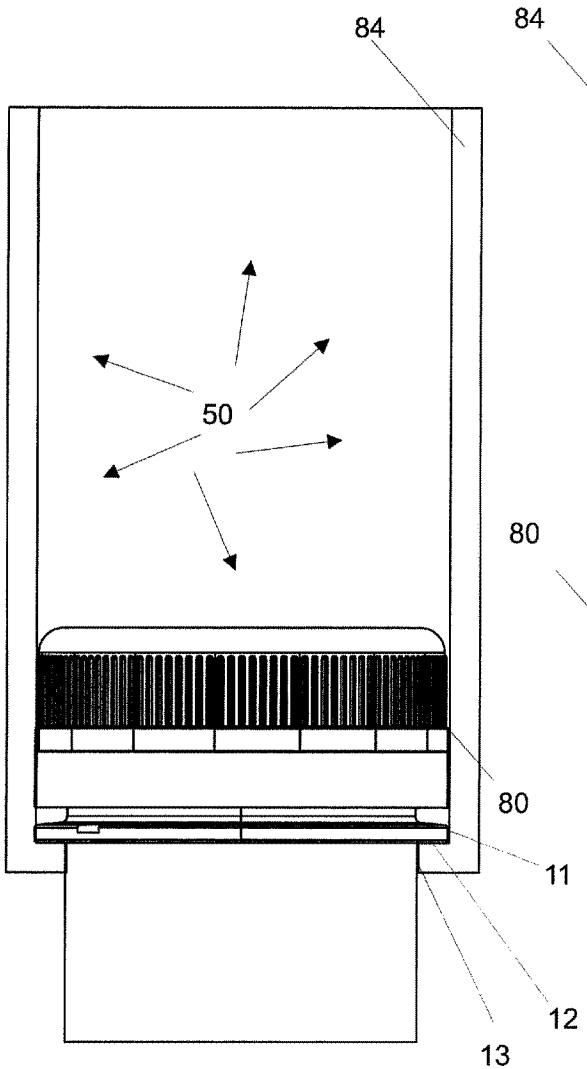
FIG. 6*a* is a schematic and side elevation view of a further embodiment of the inventions using a sealing chamber.

As seen in FIGS. 6*a-c*, in one embodiment a sealing chamber (84) is applied over the neck finish and cap combination to seal the liquid from the outside air (the upper, closed end of the structure 84 is not shown). As shown, the lower portion of the chamber (84) may seal against the outer border (11) of the neck support ring, a horizontal border (12) of the neck support ring and below the neck support ring (13). Following the introduction of a compressive force, as indicated by the arrows, for example by way of injecting air or some other gas, the increased pressure within the sealing chamber provides for a subsequent increase in pressure within the headspace (23*b*) and also forces the fluid level (40) to a lower point due to the subsequent expansion of the plastic container.

As an alternative to the injection of gas, a heated liquid could be injected, for example heated water. This would provide further advantage, in that the liquid injected would not be subject to the expansion that would normally occur when injecting gas into a heated environment. Thus less force would be ultimately applied to the sidewalls of the container during the early hot-fill stages.

Even further, the injected liquid would contract less than a gas when subsequently cooled. For this reason less liquid is necessarily required to be injected into the headspace to provide compensation for the anticipated vacuum forces that would otherwise occur.

Figure 7C:
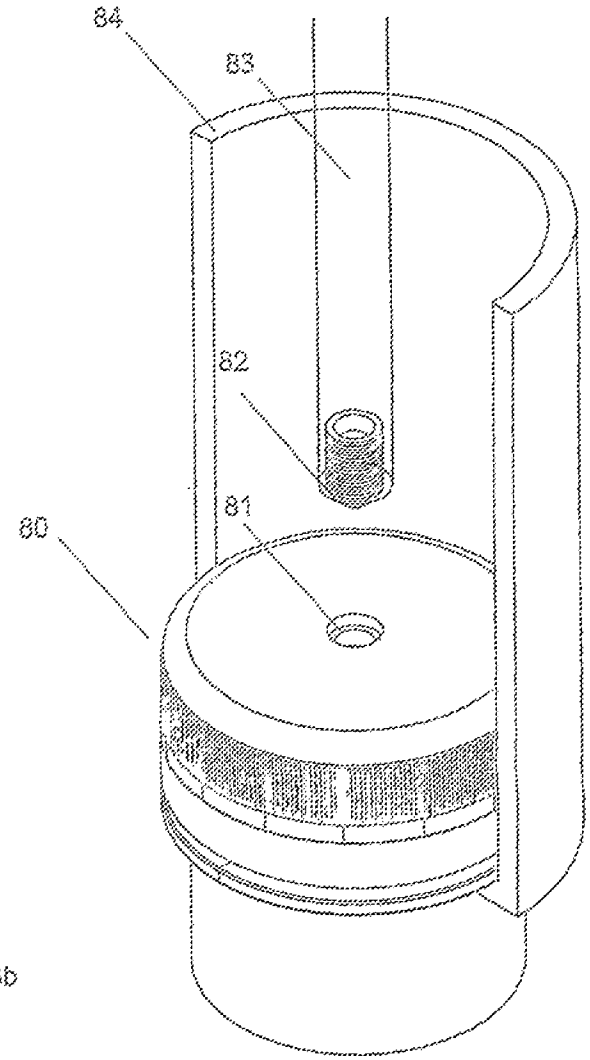
FIG. 7*c* is a schematic and upper isometric view of the assembly shown in FIG. 7*a;*
Figure 7B:
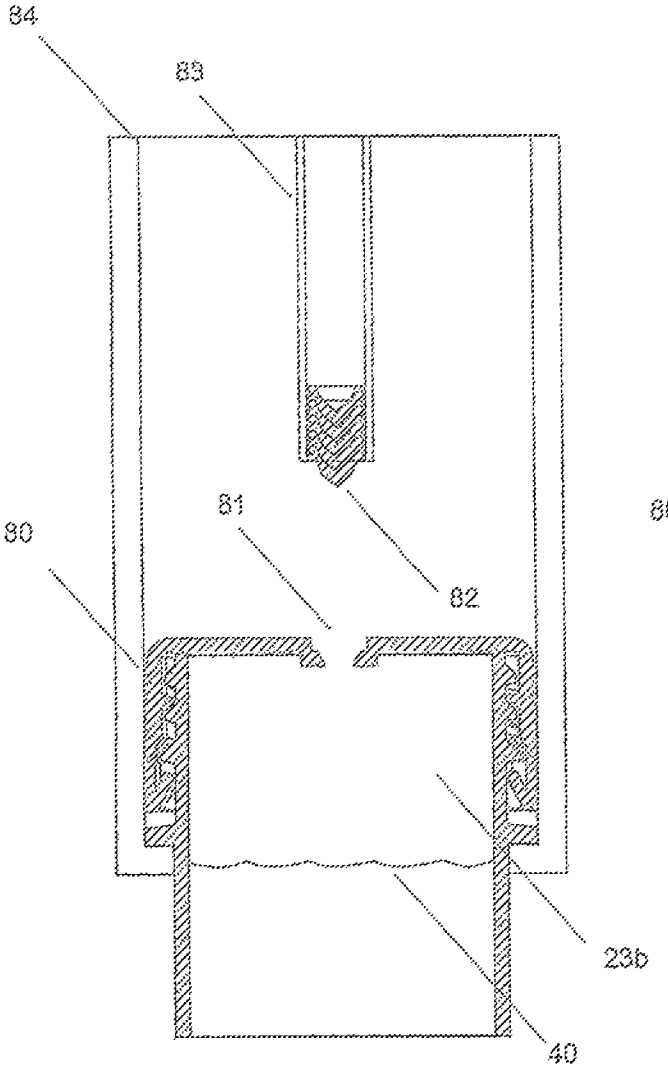
FIG. 7*b* is a schematic and cross-section of the assembly shown in FIG. 7*a;*
Figure 7A:
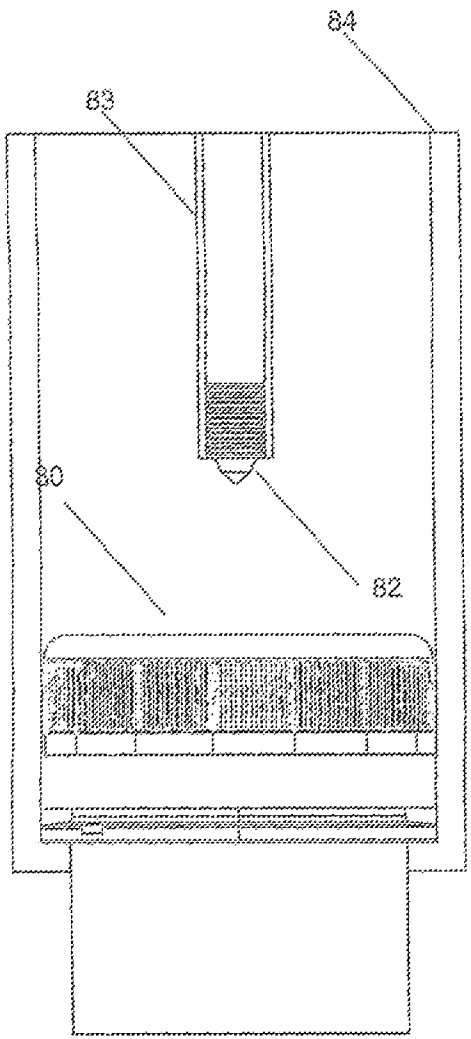
FIG. 7*a* is a schematic and side elevation view of a further embodiment of the inventions using a sealing chamber.

Now referring to FIGS. 7 *a-c* (the compressive force not shown), while pressure is maintained within the sealing chamber (84), a plug mechanism (82) is moved downwardly from a delivery device (83) towards the aperture (81).

Figure 8C:
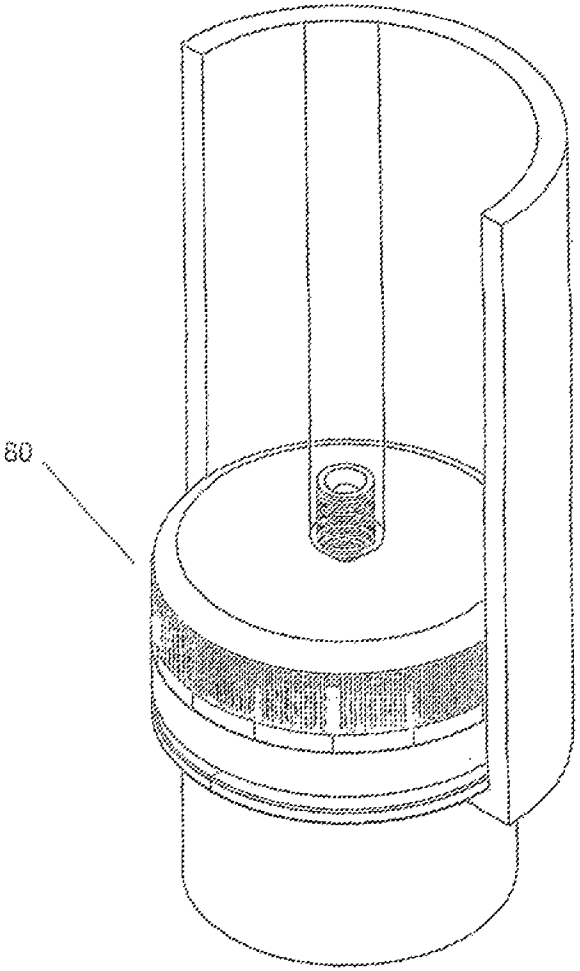
FIG. 8*c* is a schematic and upper isometric view of the assembly shown in FIG. 8*a;*
Figure 8B:
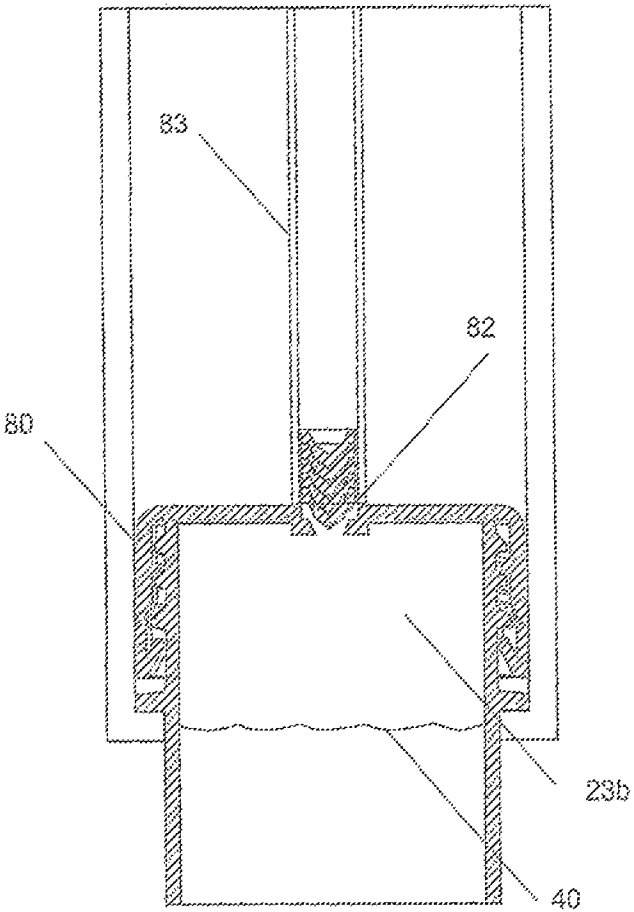
FIG. 8*b* is a schematic and cross-section of the assembly shown in FIG. 8*a;*
Figure 8A:
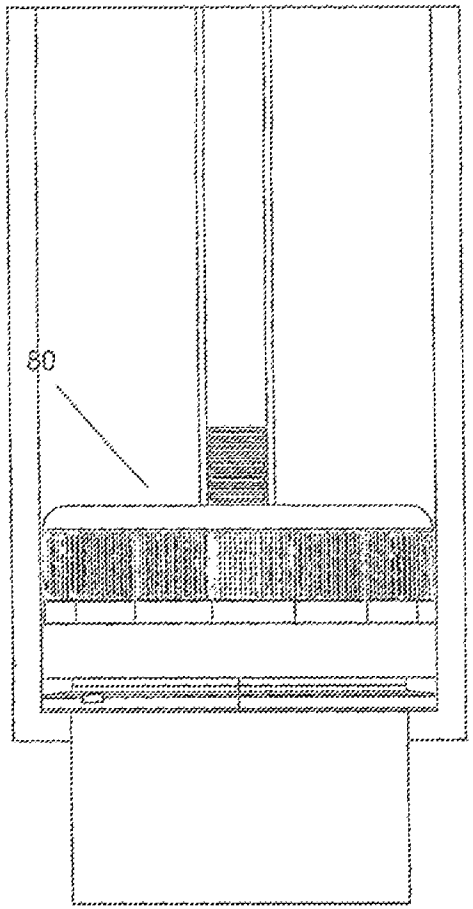
FIG. 8*a* is a schematic and side elevation view of the embodiment of the inventions shown in FIGS. 7*a*-7*c* with a delivery device inserted farther.

As can be seen in FIGS. 8 *a-c*, while pressure is maintained within the sealing chamber (84), the hole is closed off permanently by the placement of the plug (82) into the hole (81).

Figure 9C:
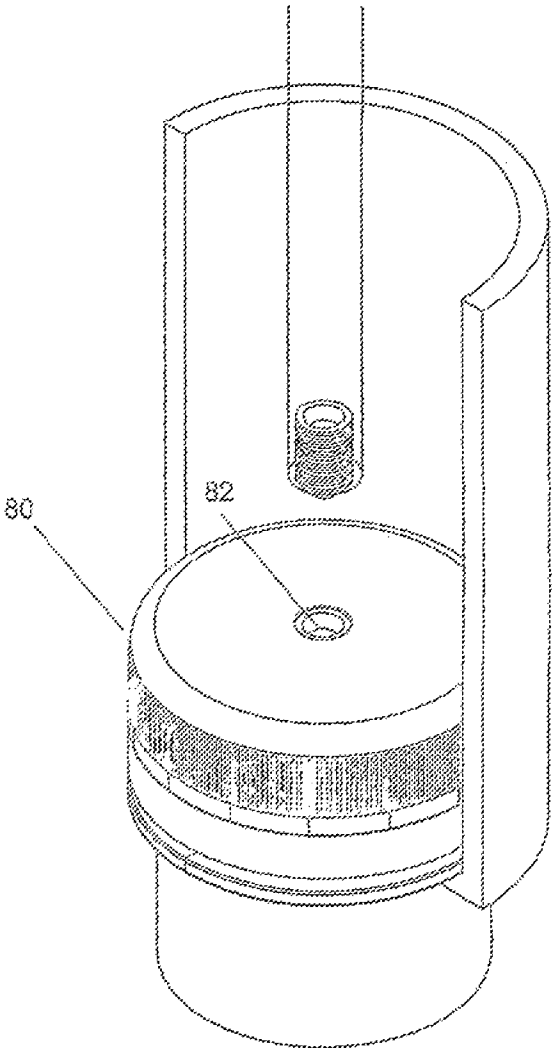
FIG. 9*c* is a schematic and upper isometric view of the assembly shown in FIG. 9*a;*
Figure 9B:
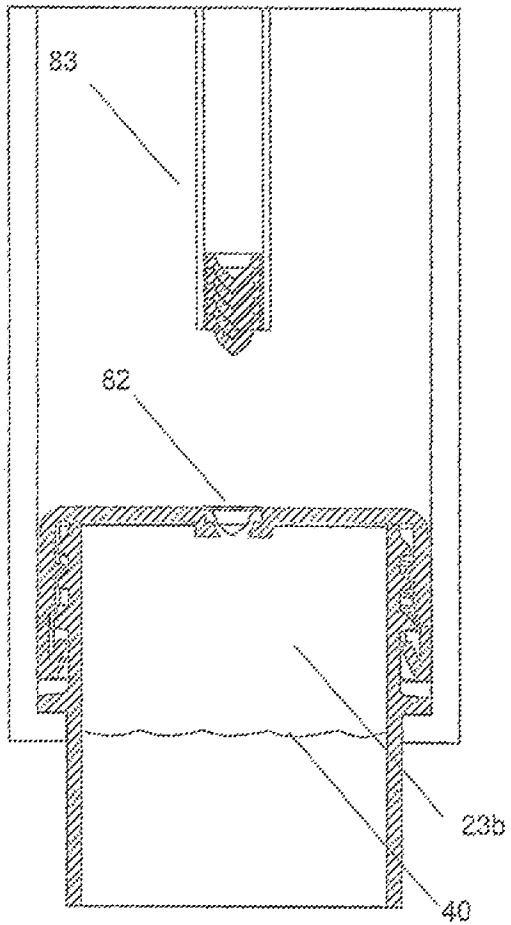
FIG. 9*b* is a schematic and cross-section of the assembly shown in FIG. 9*a;*
Figure 9A:
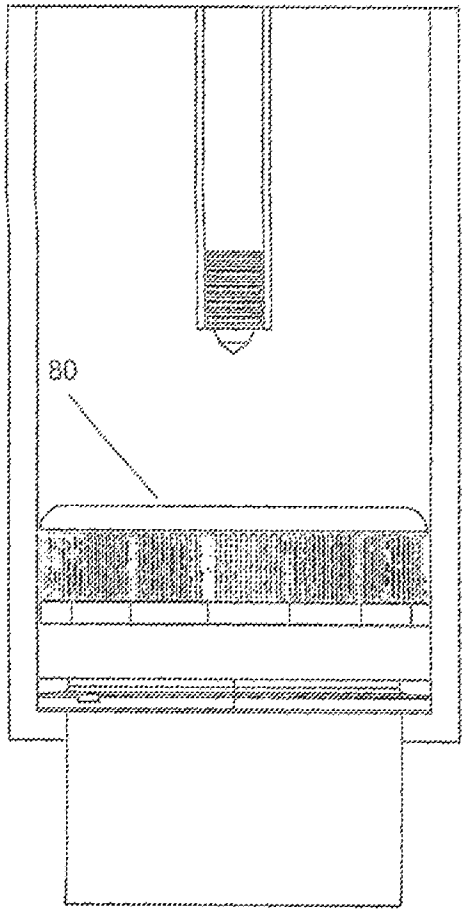
FIG. 9*a* is a schematic and side elevation view of a further embodiment of the inventions using a sealing chamber at another stage in the process.
Figure 10C:
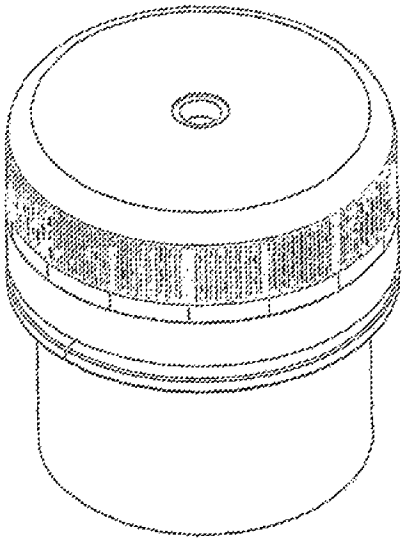
FIG. 10*c* is an upper isometric view of the assembly shown in FIG. 10*a;*
Figure 10B:
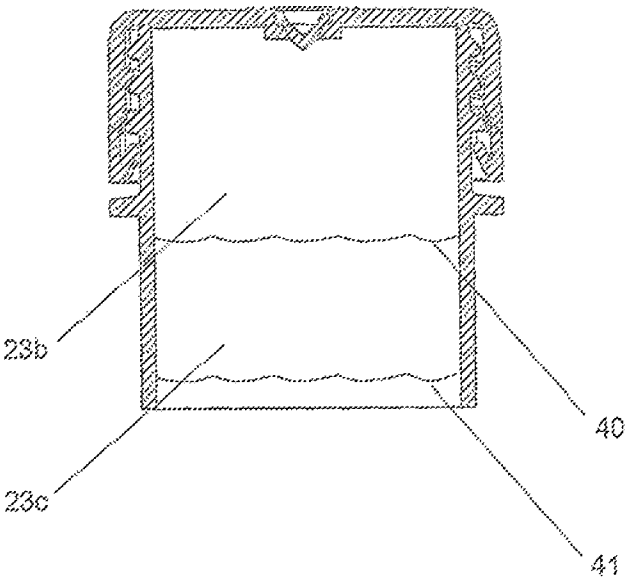
FIG. 10*b* is a cross-section of the assembly shown in FIG. 10*a;*
Figure 10A:
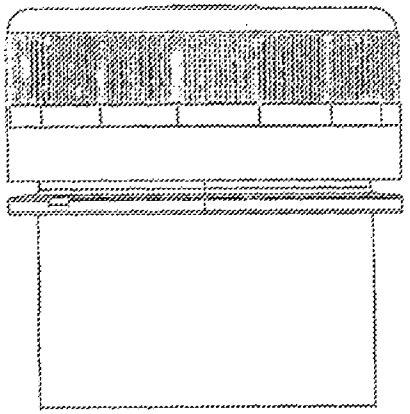
FIG. 10*a* is a side elevation view of an embodiment of the inventions in a condition in a filling line and cooled.
Figure 10F:
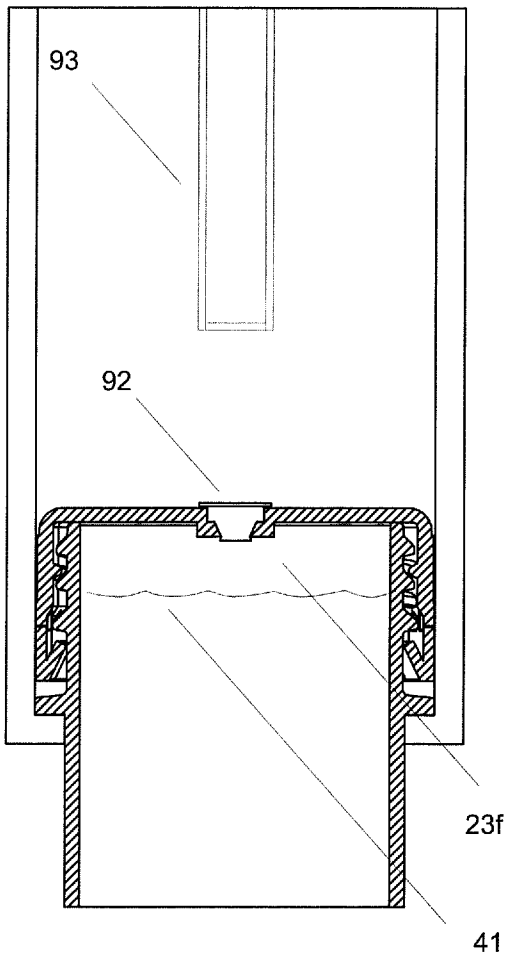
FIG. 10*f* is an upper isometric view of the assembly shown in FIG. 10*a* at another stage of a process.
Figure 10E:
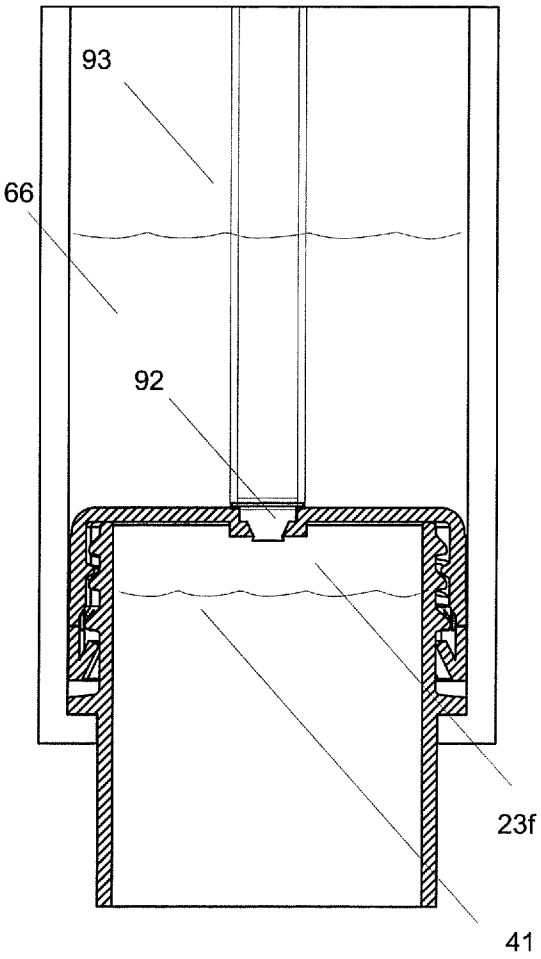
FIG. 10*e* is a cross-section of the assembly shown in FIG. 10*a* at another stage of a process.
Figure 10D:
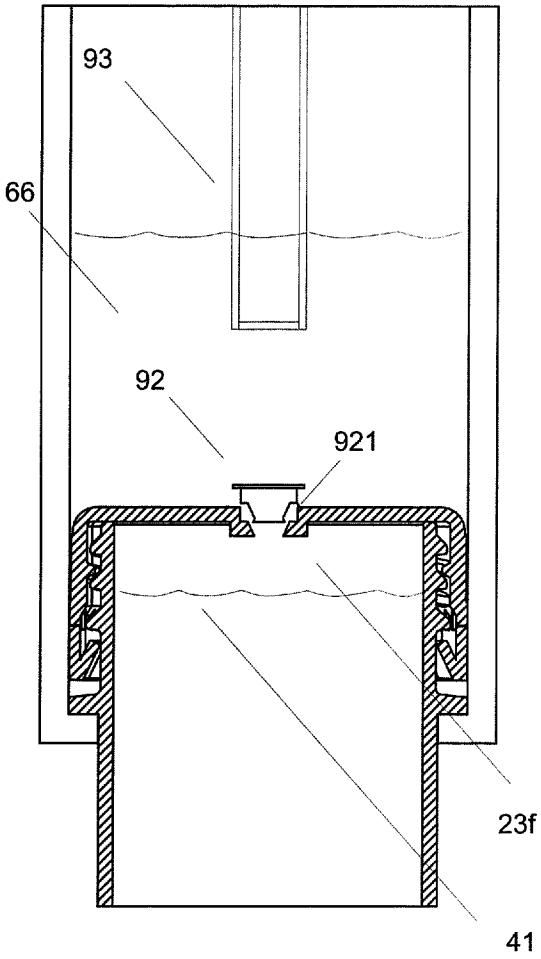
FIG. 10*d* is a cross-section of an alternative embodiment of the inventions in a filling line.

At this point, and as can be seen in FIGS. 9 *a-c*, the headspace (23*b*) is charged under a controlled pressure, dependent on the amount of gas delivered, and the sealing chamber may provide for withdrawal of the delivery device (83) following a release of pressure within the chamber as the container is ejected and returned to the filling line.

As shown in FIGS. 10 *a-c*, as the bottle subsequently travels down the filling line and is cooled, the headspace (23*b*) expands as the liquid volume shrinks. The fluid level (40) lowers to a new position (41) and the pressurised headspace (23*b*) expands and loses some or all of its pressure as it forms a new headspace (23*c*).

Importantly, however, once the contents are cooled there is no residual vacuum in the container.

As an alternative, and as shown in FIGS. 10 *d-f*, the plug 92 may be temporarily attached to the cap, for example by member 921, during production of the cap. A liquid, as in the example illustrated, or gas, could be injected in the same manner under pressure to circumnavigate the plug and enter the container headspace under pressure, and a rod mechanism 93 is then forced downwardly to advance the plug 92 into the hole permanently. In this alternative there is no need to load the rod with multiple plug mechanisms.

Figure 18:
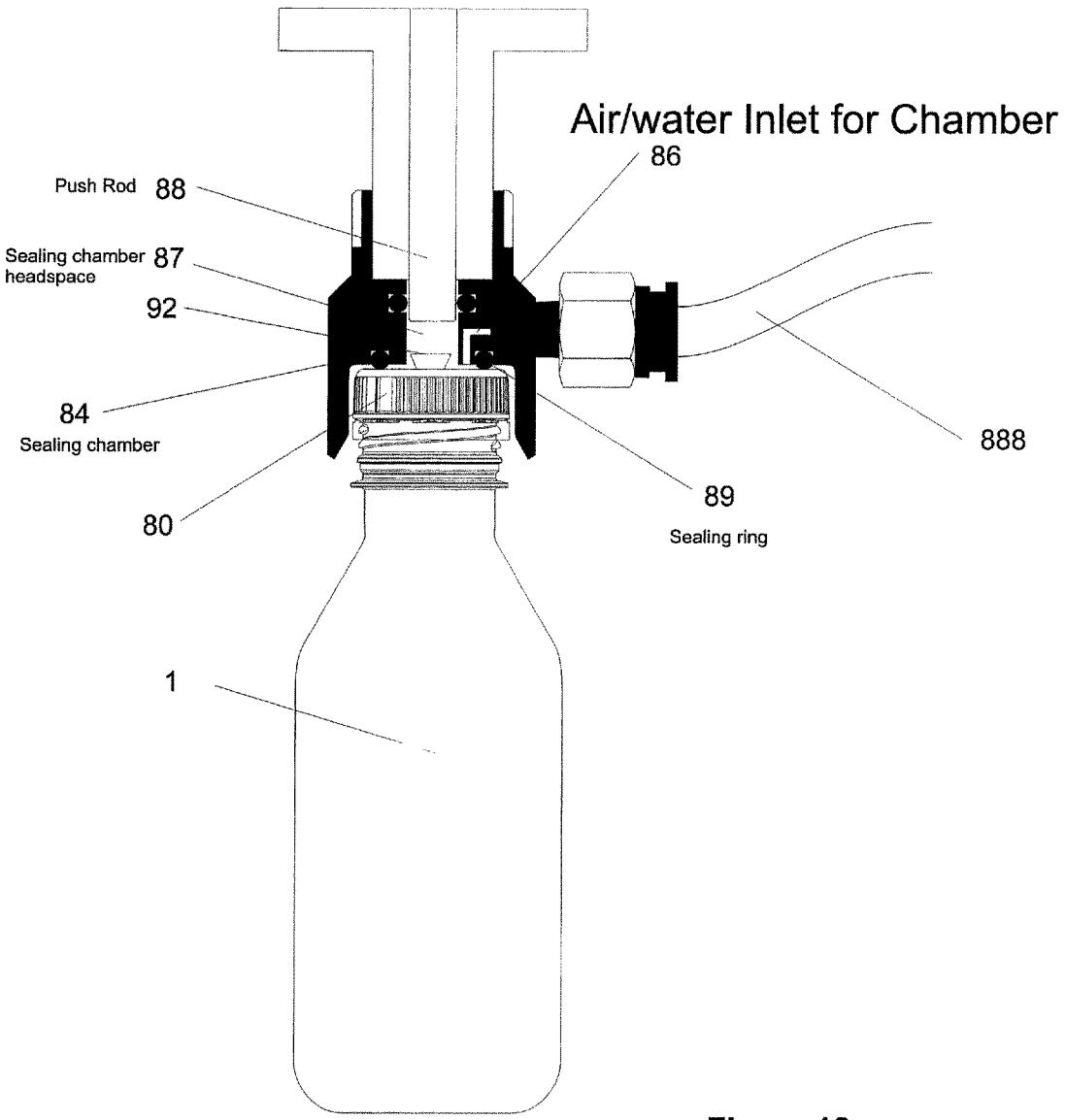
FIG. 18 shows a further possible embodiment of the inventions using a sealing chamber.

A further example of such an alternative is provided in FIG. 18. In this embodiment of the invention the cap 80 has a plug 92 temporarily attached by a member (not shown). A sealing chamber 84 encloses the cap and provides an internal sealed chamber headspace 87 through the compression of sealing rings 89 against the upper surface of the cap. Gas or liquid, or a combination of both, is injected into the chamber headspace 87 from a pressure source 888 through an inlet 86 and through the spaces around the plug into the headspace of the container. Once the required pressure within the container is obtained, the push rod 88 is advanced downwardly to force the plug 92 into position within the cap and therefore seal the container headspace under the required pressure. This provides for a calculated internal pressure to be achieved precisely at the time of sealing the container, when the plug is advanced into final position. This provides for forward compensation of the effects of subsequent vacuum generated by a cooling of any heated contents within the container.

Figure 19A:
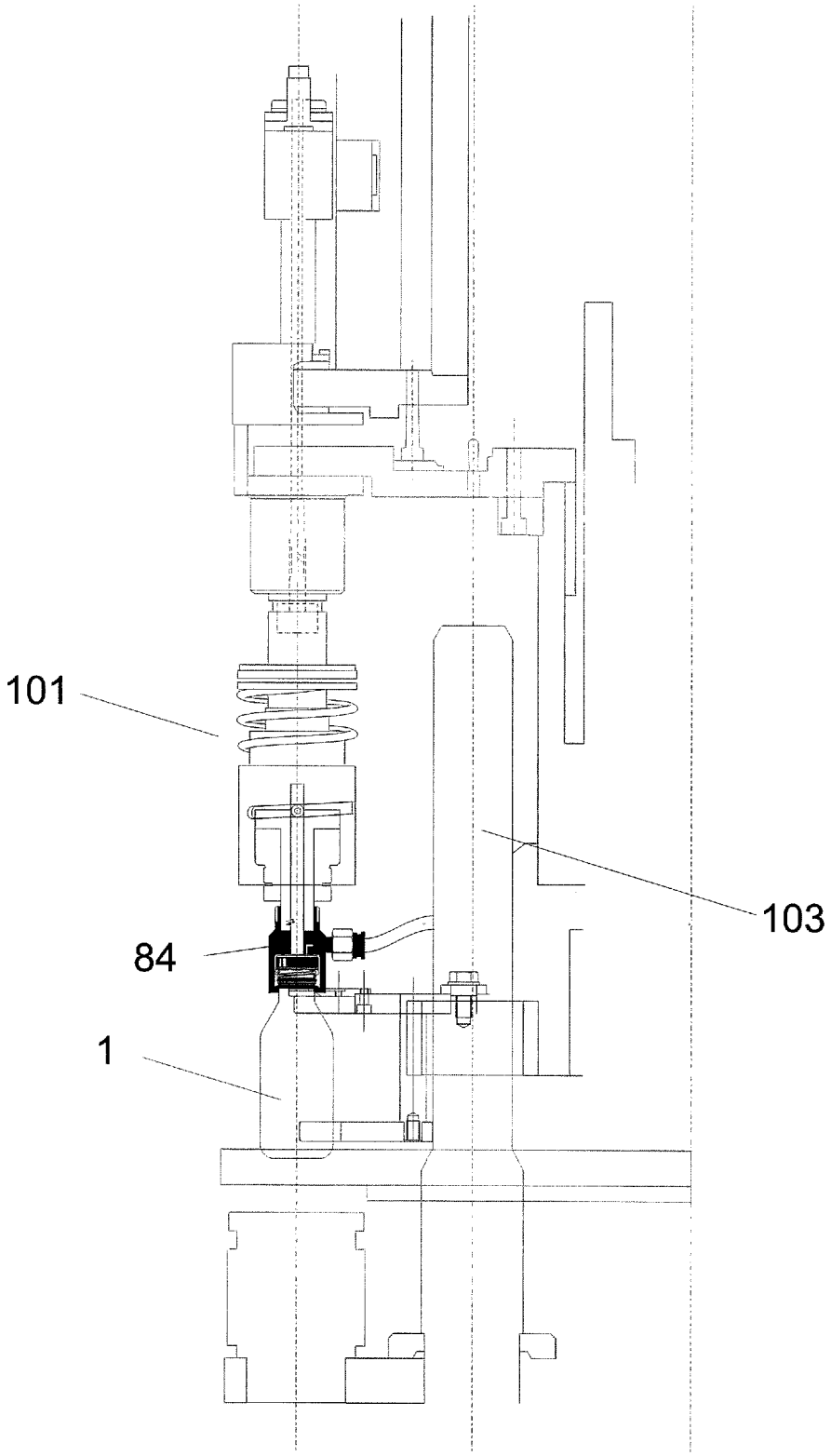
FIG. 19*a* shows an elevation view of a possible embodiment of the invention in the form of a capping machine.
Figure 19B:
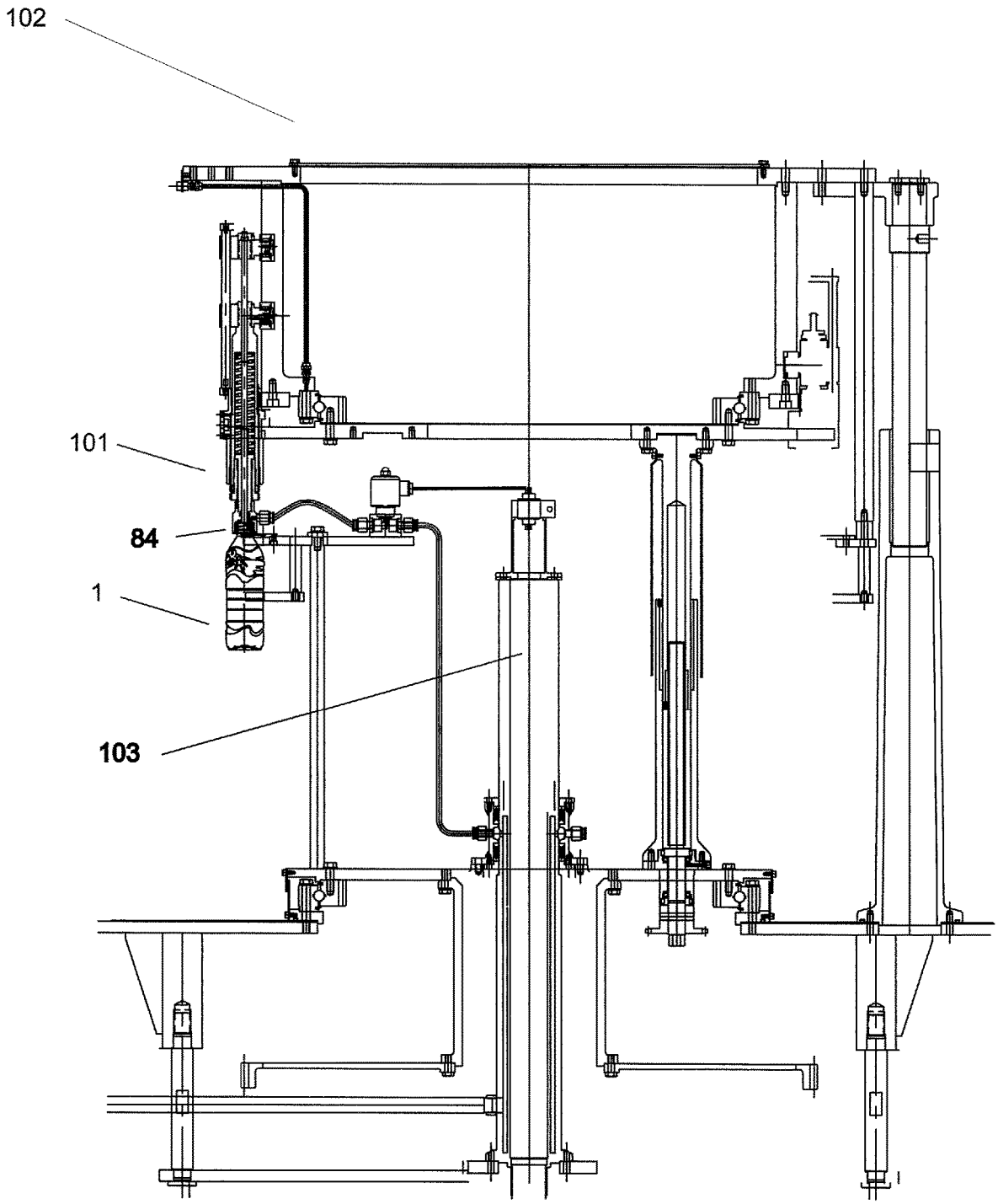
FIG. 19*b* shows another elevation view of a possible embodiment of the invention in the form of a capping machine.
Figure 20C:
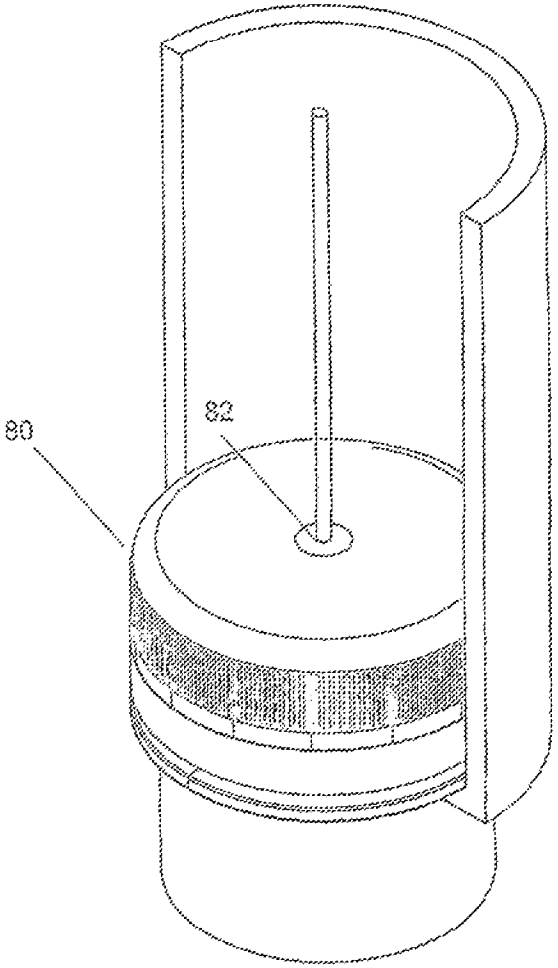
FIG. 20*c* is an upper isometric view of the assembly shown in FIG. 20*a;*
Figure 20B:
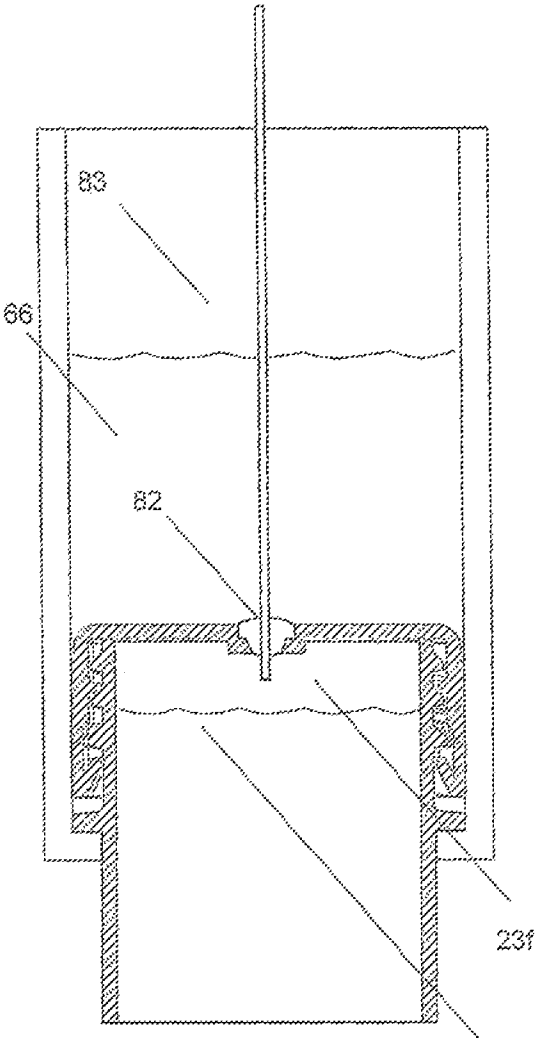
FIG. 20*b* is a cross-section of the assembly shown in FIG. 20*a;*
Figure 20A:
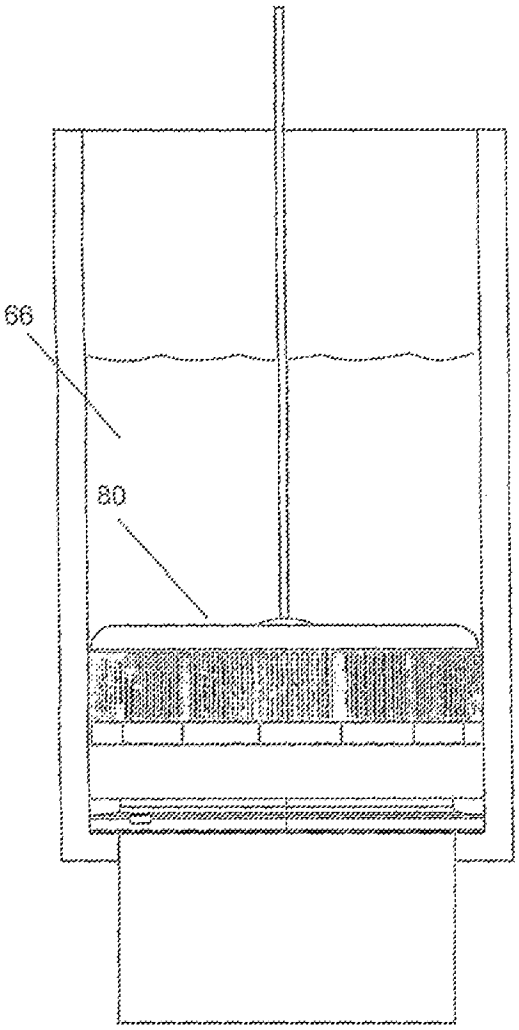
FIG. 20*a* is a schematic and side elevation view of a further embodiment of the inventions.
Figure 20F:
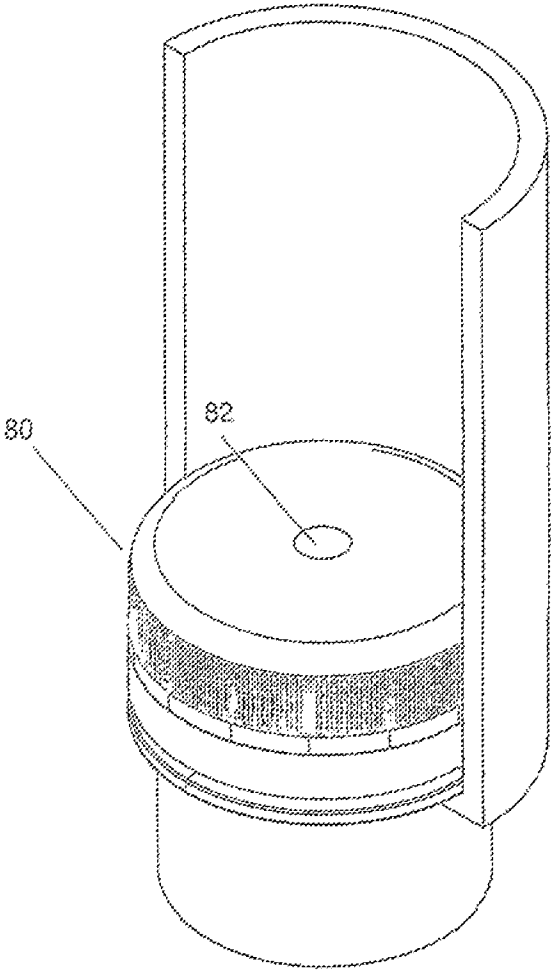
FIG. 20*f* is an upper isometric view of the assembly shown in FIG. 20*a;*
Figure 20E:
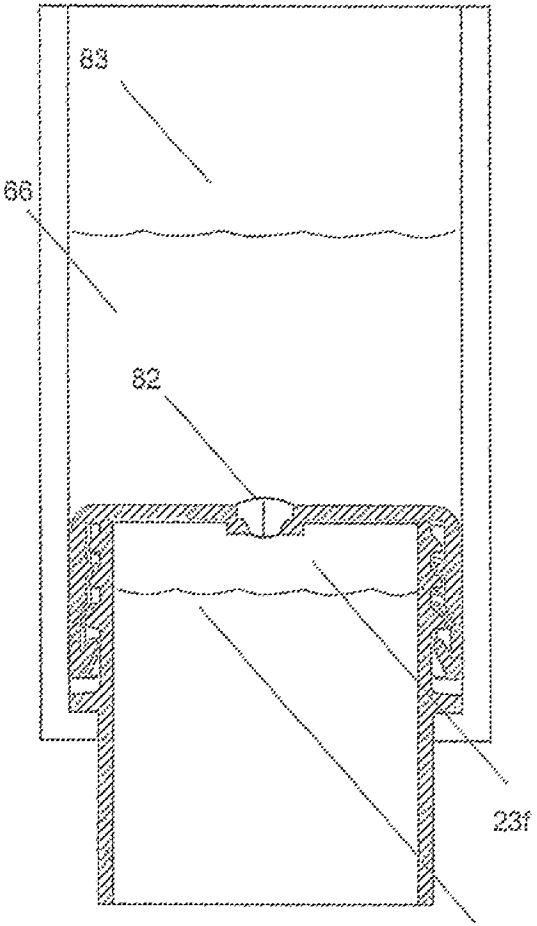
FIG. 20*e* is a cross-section of the assembly shown in FIG. 20*a;*
Figure 20D:
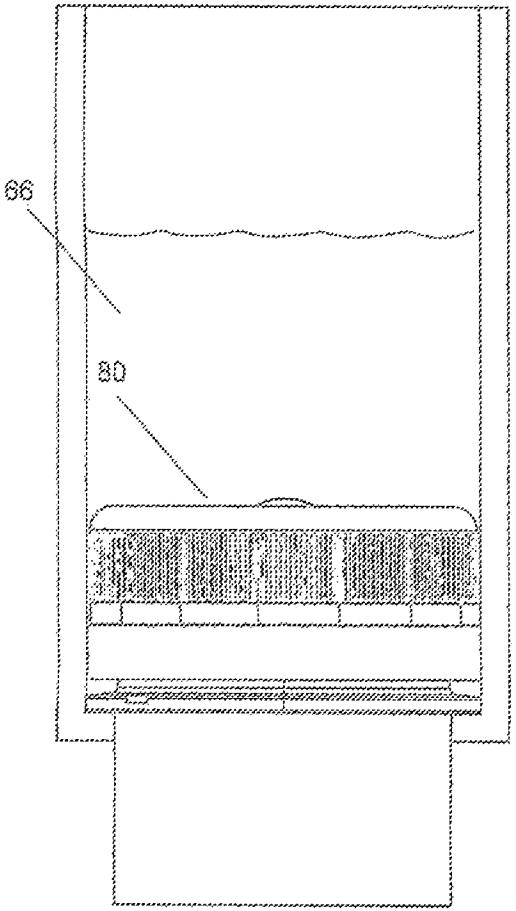
FIG. 20*d* is a schematic and side elevation view of the assembly shown in FIG. 20*a;*
Figure 21C:
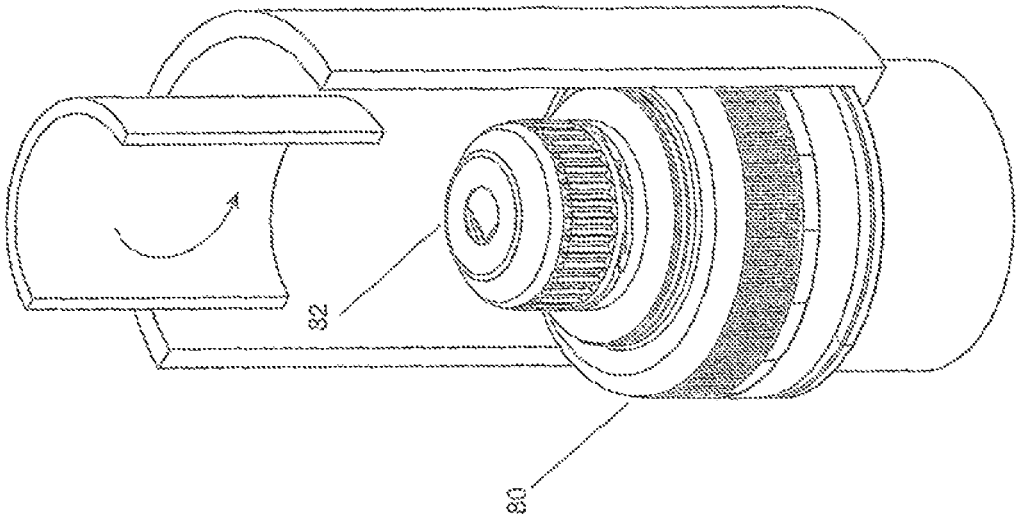
FIG. 21*c* is an upper isometric view of the assembly shown in FIG. 21*a;*
Figure 21B:
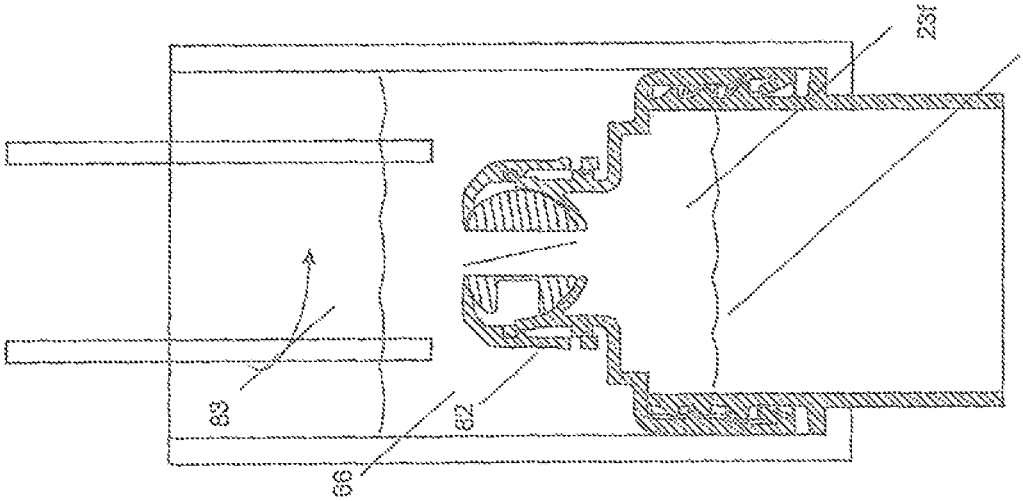
FIG. 21*b* is a cross-section of the assembly shown in FIG. 21*a;*
Figure 21A:
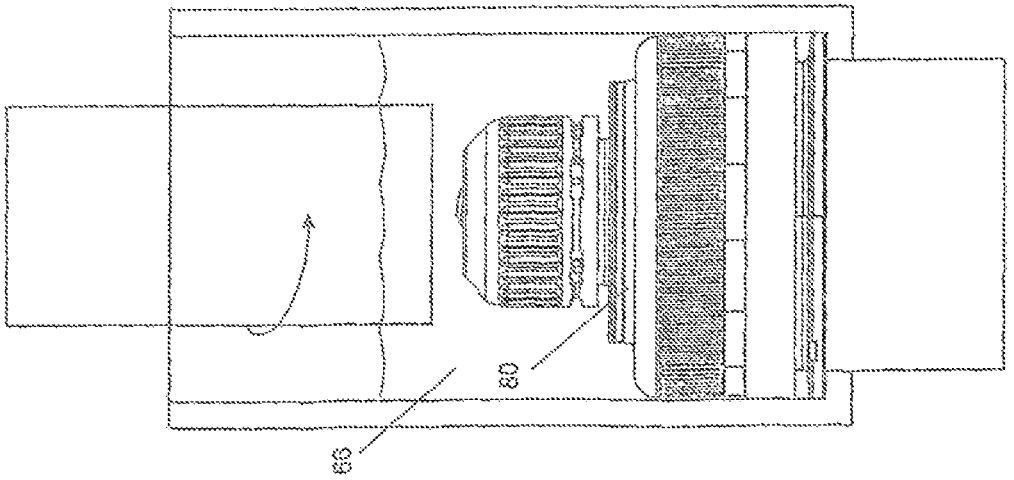
FIG. 21*a* is a schematic and side elevation view of another embodiment of the inventions.
Figure 21F:
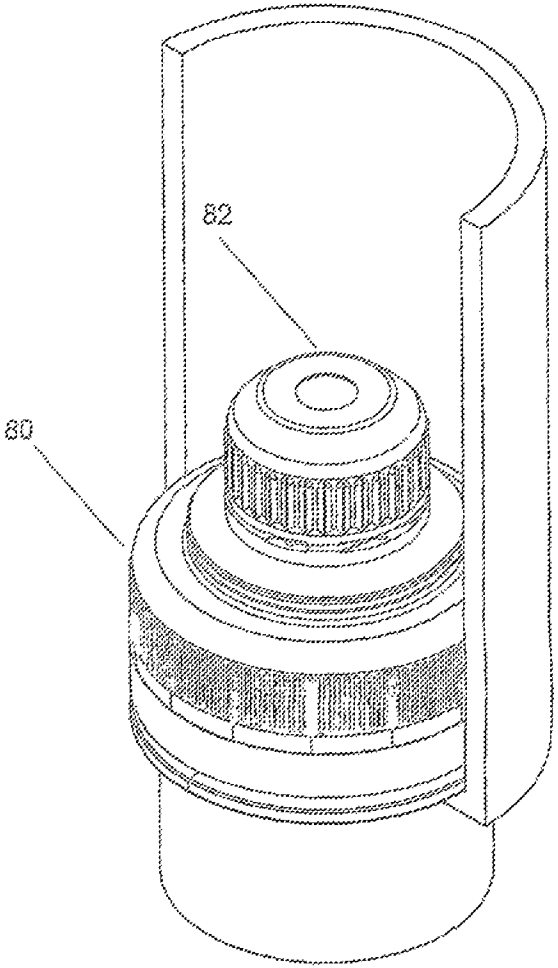
FIG. 21*f* is an upper isometric view of the assembly shown in FIG. 21*a;*
Figure 21E:
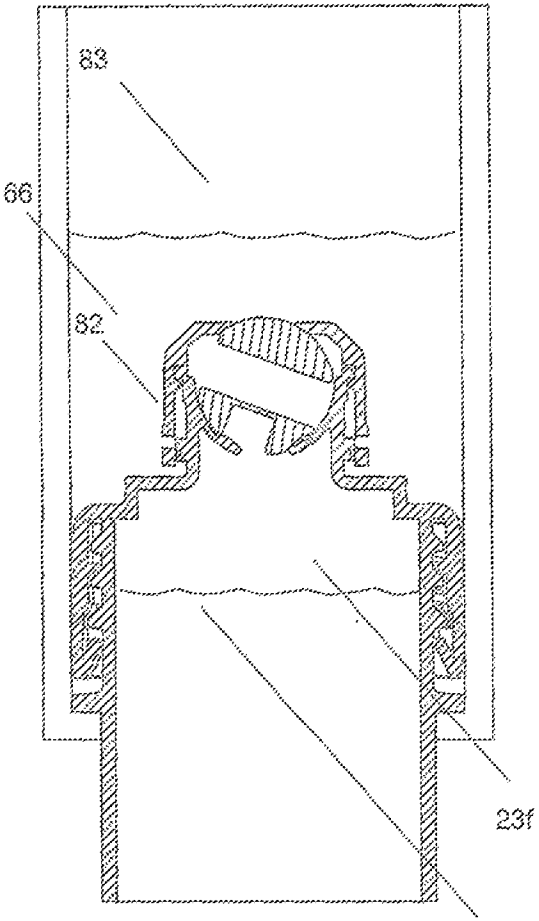
FIG. 21*e* is a cross-section of the assembly shown in FIG. 21*a;*
Figure 21D:
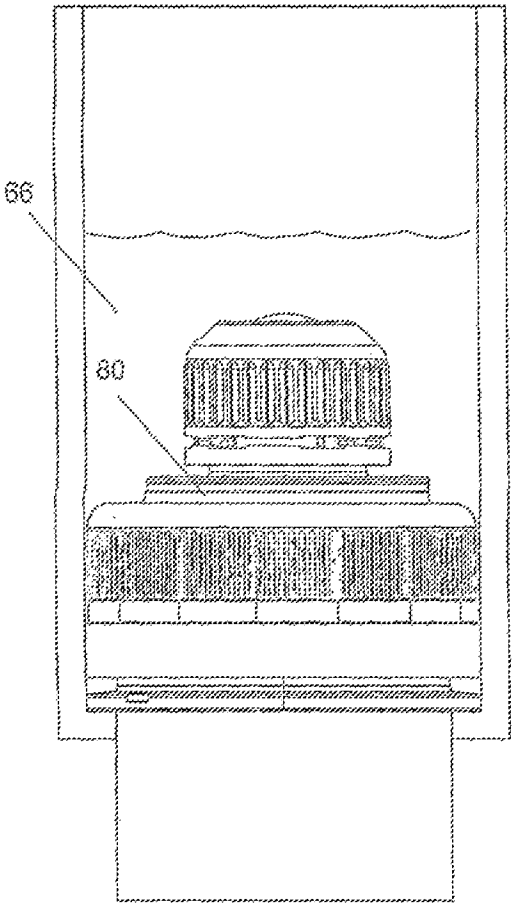
FIG. 21*d* is a schematic and side elevation view of the assembly shown in FIG. 21*a;*

With reference to FIGS. 19*a* and 19*b*, the present invention may be manufactured to function along very similar lines to a typical capping station on a filling line. A typical capping machine head unit 101 encapsulates the sealing unit 84 and provides the function of sealing and pressurising the container through applying the cap to seal the container while under increased pressure. Alternatively, a typical capping unit may have optionally already torqued the cap into position, but the container would remain unsealed due to the presence of a plug being in an 'unplugged' position within the cap and allowing the passage of liquid or gas between the inside and outside of the container. The precise moment of sealing the container occurs as the plug is rammed into position and the headspace within the cap is not at ambient pressure, as would be typical of prior art capping procedures within the filling and capping area, but instead with the present invention a headspace modification unit 102 including the capping head unit 101, the pressurizing and sealing unit 84, and the rotatable turret 103, may receive capped containers 1, and subsequently pressurise the container immediately prior to sealing the container with a cap sealing plug.

As an alternative, the headspace modification unit 102, including the capping unit 101, the pressurizing and sealing unit 84, and the rotatable turret 103, can also perform the usual function of a typical capping machine. The unit could receive empty containers, apply caps containing the plugs and subsequently torque the caps into position as well as pressurise the container prior to ultimately sealing the container through advancing the plug or some other sealing method.

Still further examples of alternative embodiments of the present invention are illustrated in FIGS. 20 *a-f*. The cap 80 may incorporate a rubber, or other suitable material, plug 182 within the cap. This would provide the advantage of having an initially leakproof seal to the container prior to pressurising the headspace. In this way, the container could be charged with pressure from a liquid or gas either prior to the cooling of the contents, for example immediately after filling and capping by way of overpressure, or the procedure could occur after the contents have been cooled and there is a vacuum within the container. By way of example, the cap and sealing plug 182 could be sterilized by very hot water 66 after the liquid contents have cooled. This would sterilize the upper surface of the cap and a heated liquid could then be injected to compensate for vacuum pressure. Following withdrawal of the injecting needle 202, the sterilizing heated liquid could be removed as the container is ejected from the pressure chamber. The rubber seal 182 would have closed off and sealed the container to prevent any communication between the headspace under the cap and outside air present as the chamber is opened.

A further alternative for a suitable plug mechanism within a cap 80 is illustrated in FIGS. 21 *a-f*. A ball-valve type closure 882 could be utilized to provide a hole through which headspace modification may occur within the pressure chamber unit as previously described. Once the headspace has been pressurized, a rotating push rod 883 can close the ball valve while the headspace is maintained under exact pressure as illustrated in FIGS. 21 *d-f*.

Figure 22A:
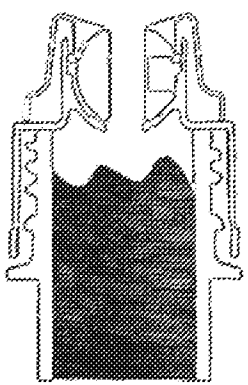
FIG. 22*a* is a longitudinal cross section of a further embodiment of the inventions according to a method.
Figure 22B:
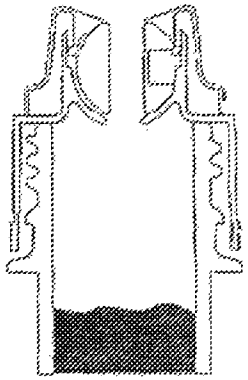
FIG. 22*b* is a cross-section of the assembly shown in FIG. 22*a;*
Figure 22C:
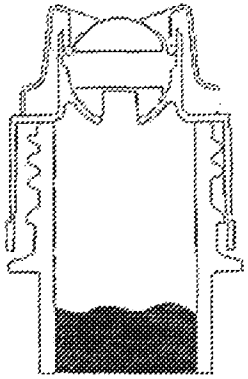
FIG. 22*c* is a cross-section of the assembly shown in FIG. 22*a;*

FIGS. 22*a-c* shows a typical example method of headspace modification using the method of the present invention. An empty container (not shown below the neck finish) is filled or even 'overfilled' to the brim of the neck finish, and a cap is applied that has an opening through which headspace modification can be achieved, for example a ball-valve closure device. The capped neck finish, at least, is contained within a pressure chamber (not shown) and the container is placed under a calculated pressure. This increase in pressure may be by injection of a gas as in the illustrated example, or by over injection of further liquid. During this process the container will increase in size to a degree allowing the fluid level to drop (if gas is being injected) and the ball-valve closure may then be closed to maintain the increased pressure within the container.

Figure 23A:
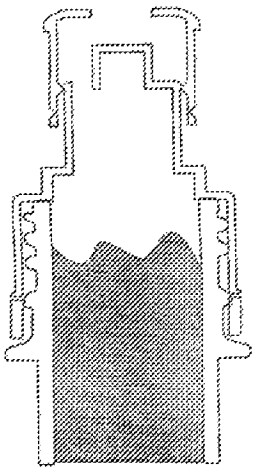
FIG. 23*a* is a longitudinal cross section of a further embodiment of the inventions according to a method for another configuration.
Figure 23B:
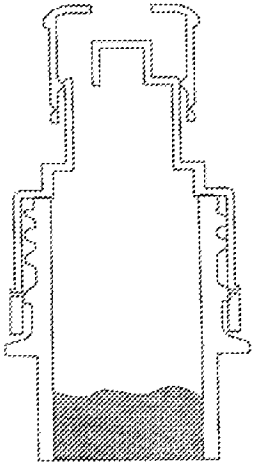
FIG. 23*b* is a cross-section of the assembly shown in FIG. 23*a;*
Figure 23C:
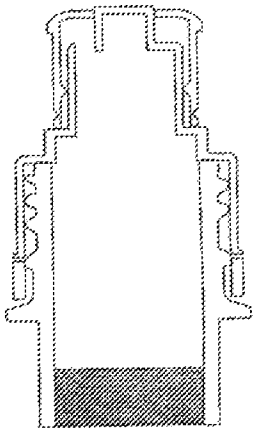
FIG. 23*c* is a cross-section of the assembly shown in FIG. 23*a;*

The same method procedure may occur using a more typical 'push-pull' type sport closure as illustrated in similar manner in FIGS. 23 *a-c*.

Figure 17C:
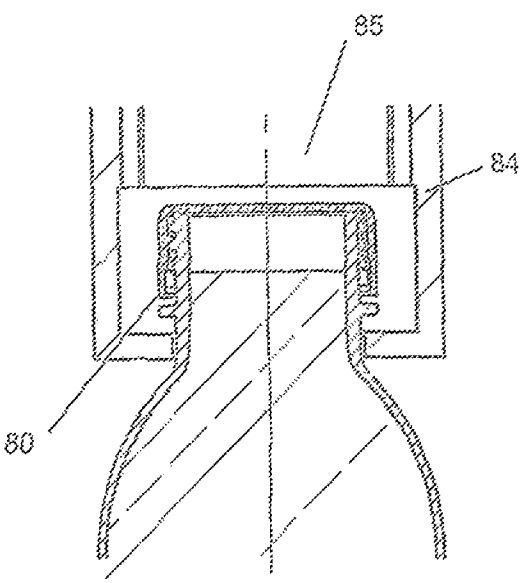
FIG. 17*c* is a schematic and cross-section of part of the assembly shown in FIG. 17*a;*
Figure 17B:
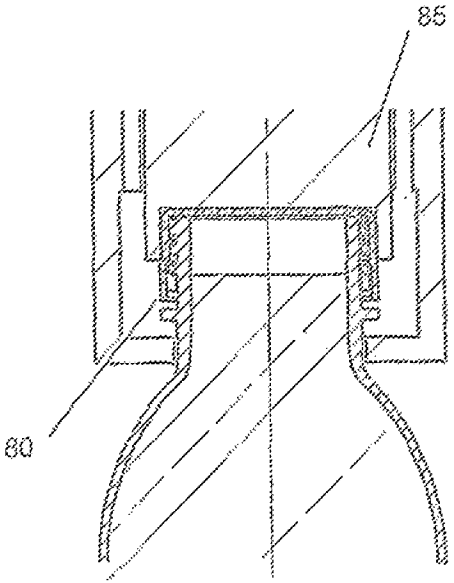
FIG. 17*b* is a schematic and cross-section of the assembly shown in FIG. 17*a;*
Figure 17A:
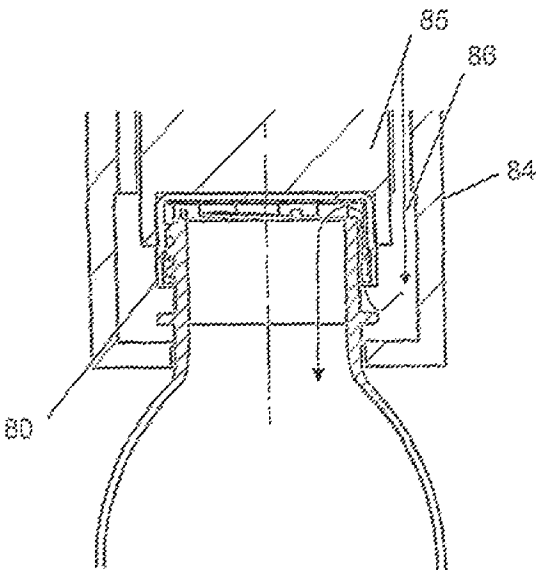
FIG. 17*a* is a schematic and side elevation view of a further embodiment of the inventions using a sealing chamber.

As a further alternative to the present invention, and to remove the need for a hole or plug mechanism within the cap itself, and with reference to FIGS. 17*a-c*, a normal cap could be applied by a capping unit but not forcibly torqued into position. The neck finish can then be enclosed within the chamber 84 and the liquid or gas forced into the container through the gap between the cap and the thread mechanisms of the neck finish, as shown by passage of liquid 86. Once the desired pressure is obtained the cap, as shown in FIG. 17*b*, can then be torqued into position by advancing the torque rod 85 within the chamber 84 while holding the container headspace at pressure. In this embodiment the method may be achieved using standard caps rather than modified caps. FIG. 17*c* illustrates removal of the torque rod 85, correctly torqued cap 80, immediately prior to ejecting the container head from the chamber 84.

It will be appreciated that the present invention offers multiple choices in carrying out a headspace modification procedure by way of modifying a typical capping machine. Such a piece of machinery could easily be employed to also provide the function of capping the container in addition to modifying the headspace during the procedure.

Figure 24:
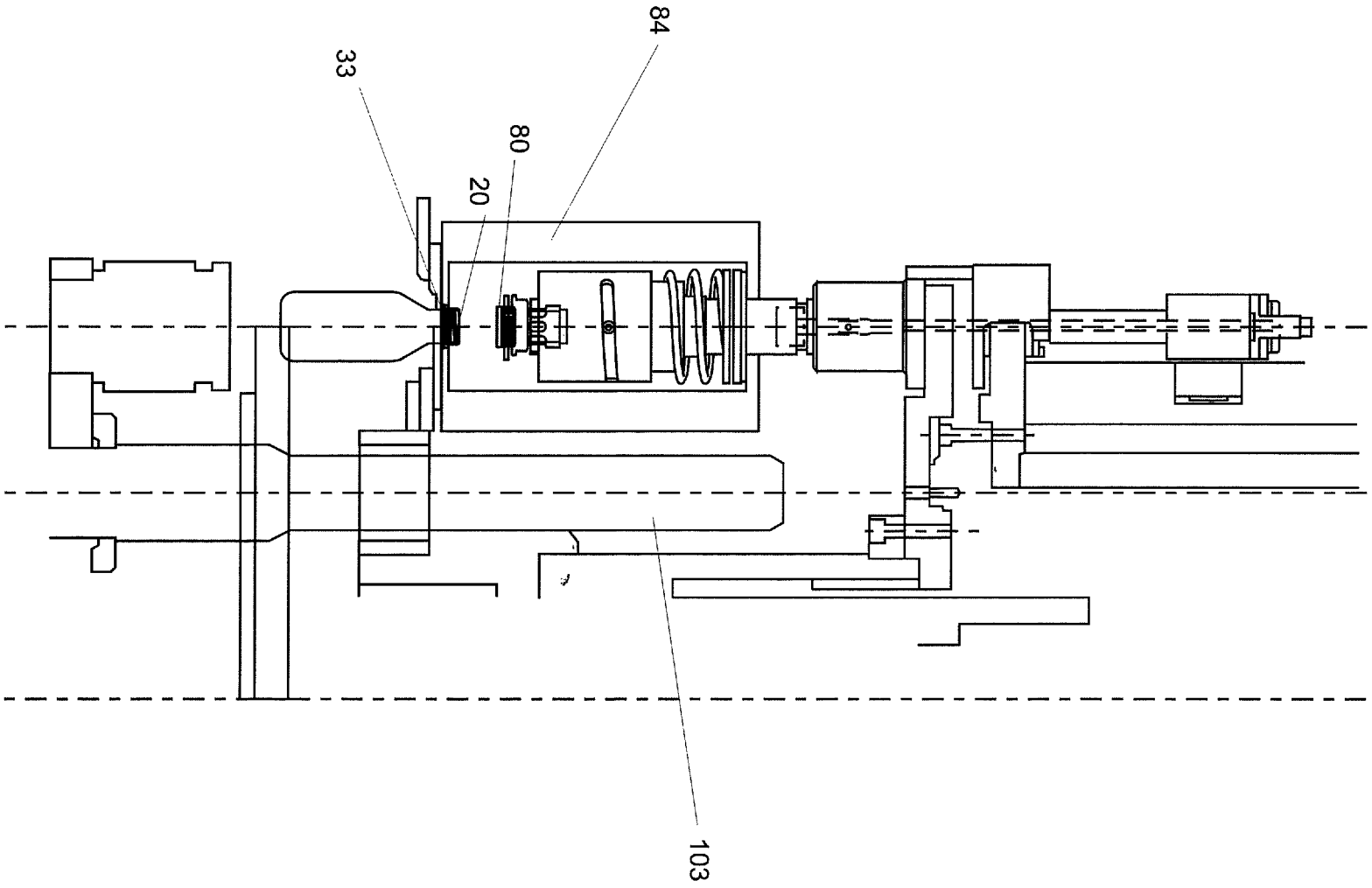
FIG. 24 shows an embodiment of the inventions using a sealing chamber.

FIG. 24 shows how a container could be contained within a typical sealing chamber 84 from immediately below the neck support ring 33 of the container.

Figure 25:
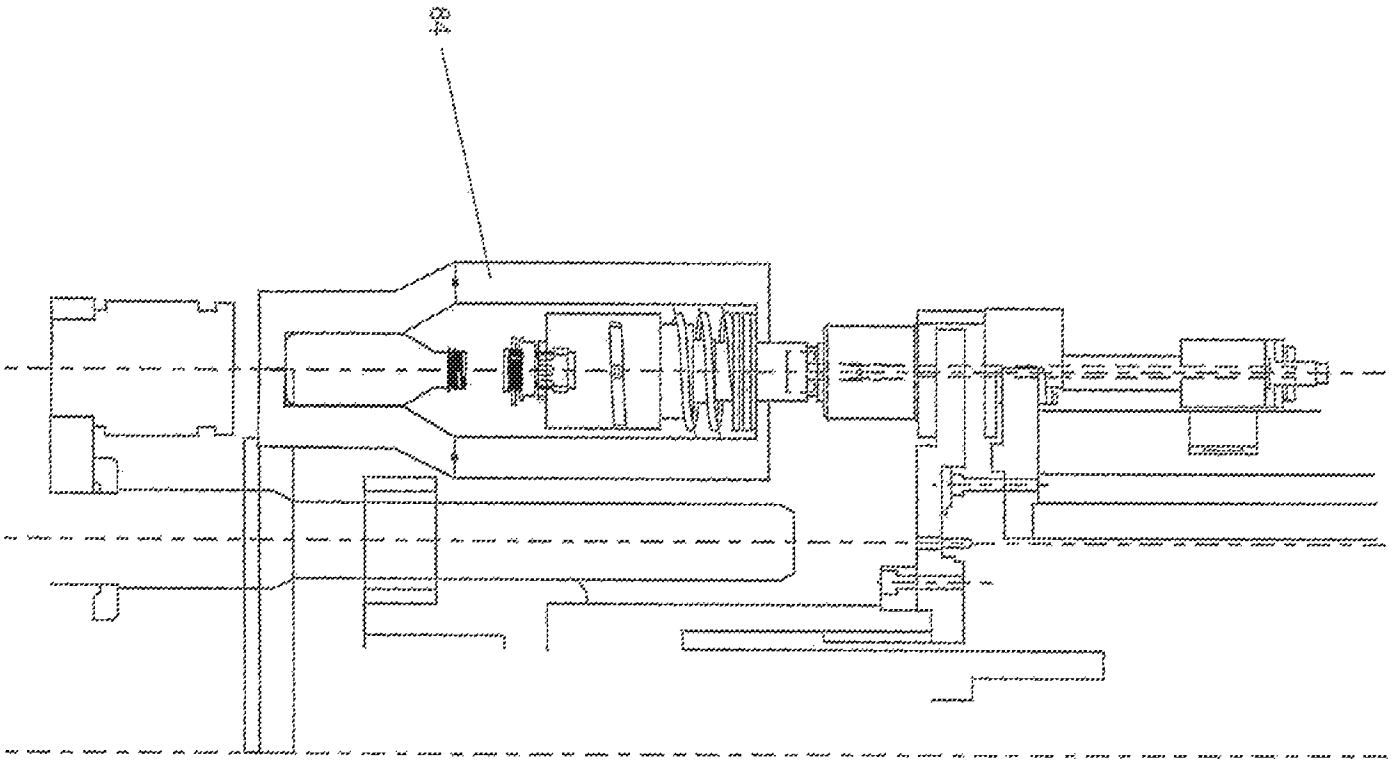
FIG. 25 shows an embodiment of the inventions using another example of a sealing chamber.

FIG. 25 illustrates how the whole container could be contained within a sealing chamber 84. In this embodiment the container will not be stressed from the increased pressure until after ejection from the sealing chamber.

Figure 26:
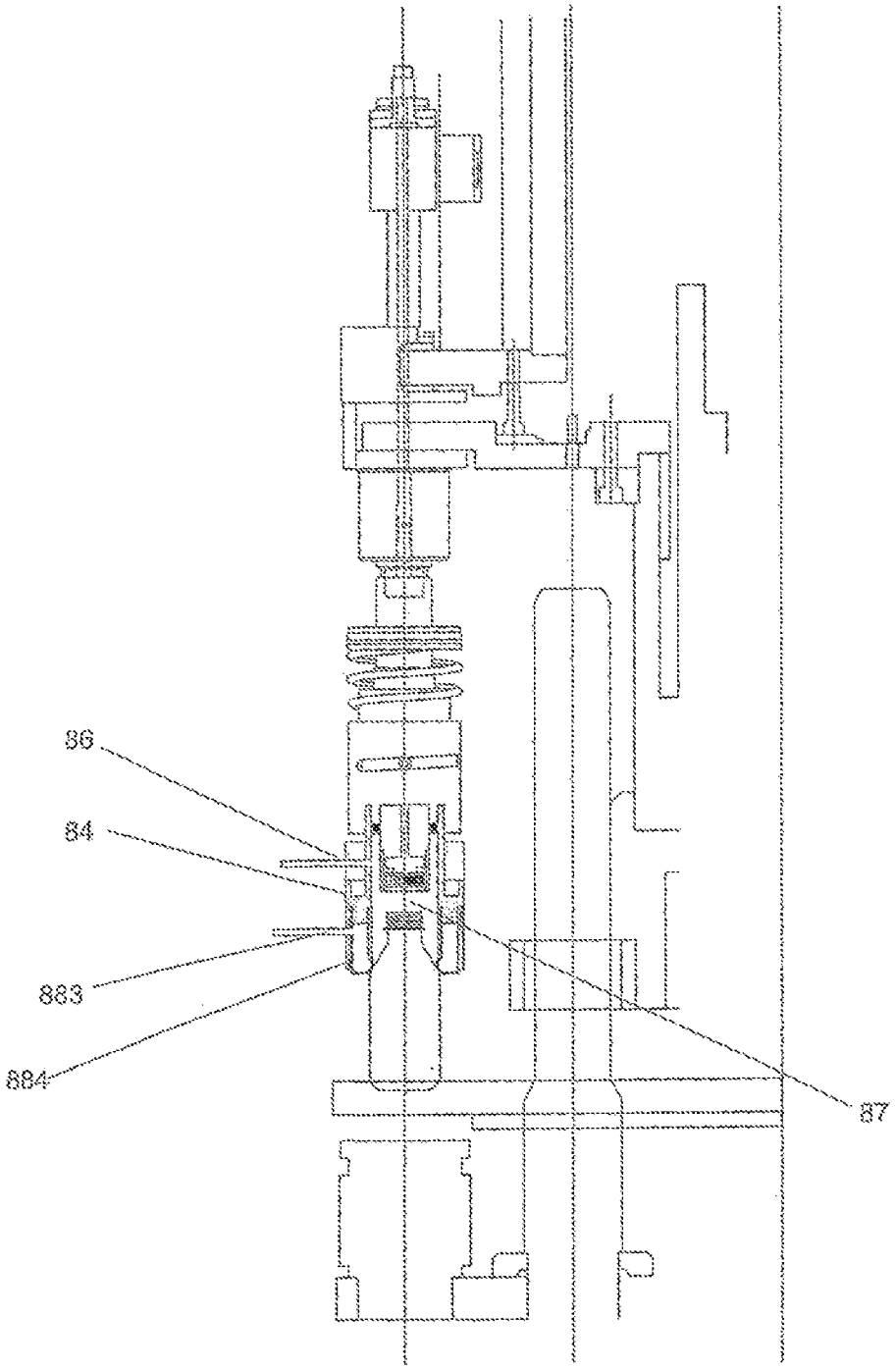
FIG. 26 shows an embodiment of the inventions using another example of a sealing chamber.

FIG. 26 shows an alternative embodiment of the present invention. It is envisaged that the sealing chamber 84 could comprise optionally a lower end sealing skirt 884. In this example, a sealing ring of soft material may be inflated under pressure of water or gas through an inlet 883 to form a close contact with the container shoulder. Gas or liquid may then be charged into the pressure chamber headspace 87 through inlet 86 to modify the container headspace prior to final sealing.

Figure 27:
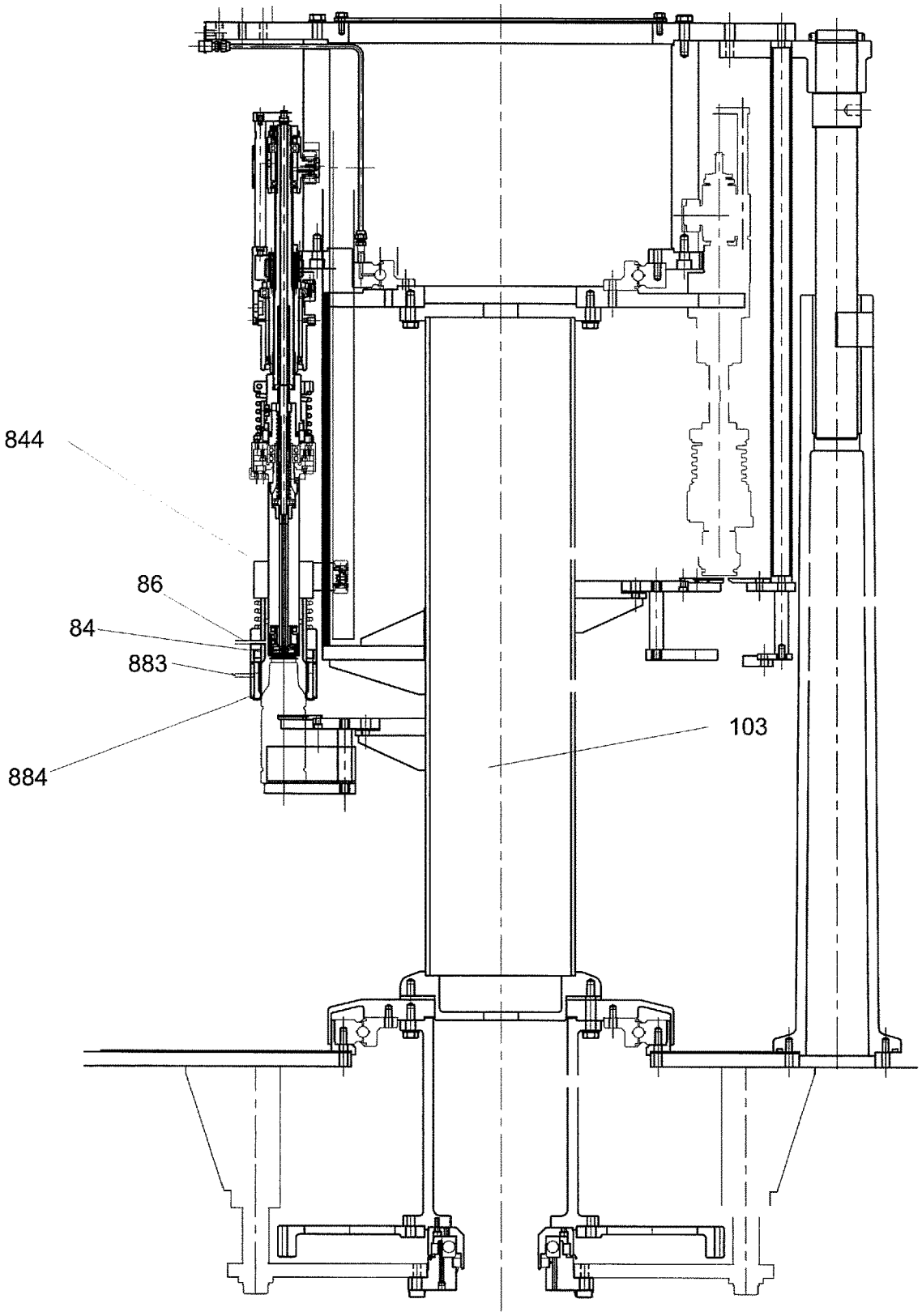
FIG. 27 shows an embodiment of the inventions using the example of the sealing chamber of FIG. 26.
Figures 28A, 28B, 28C, 28D:
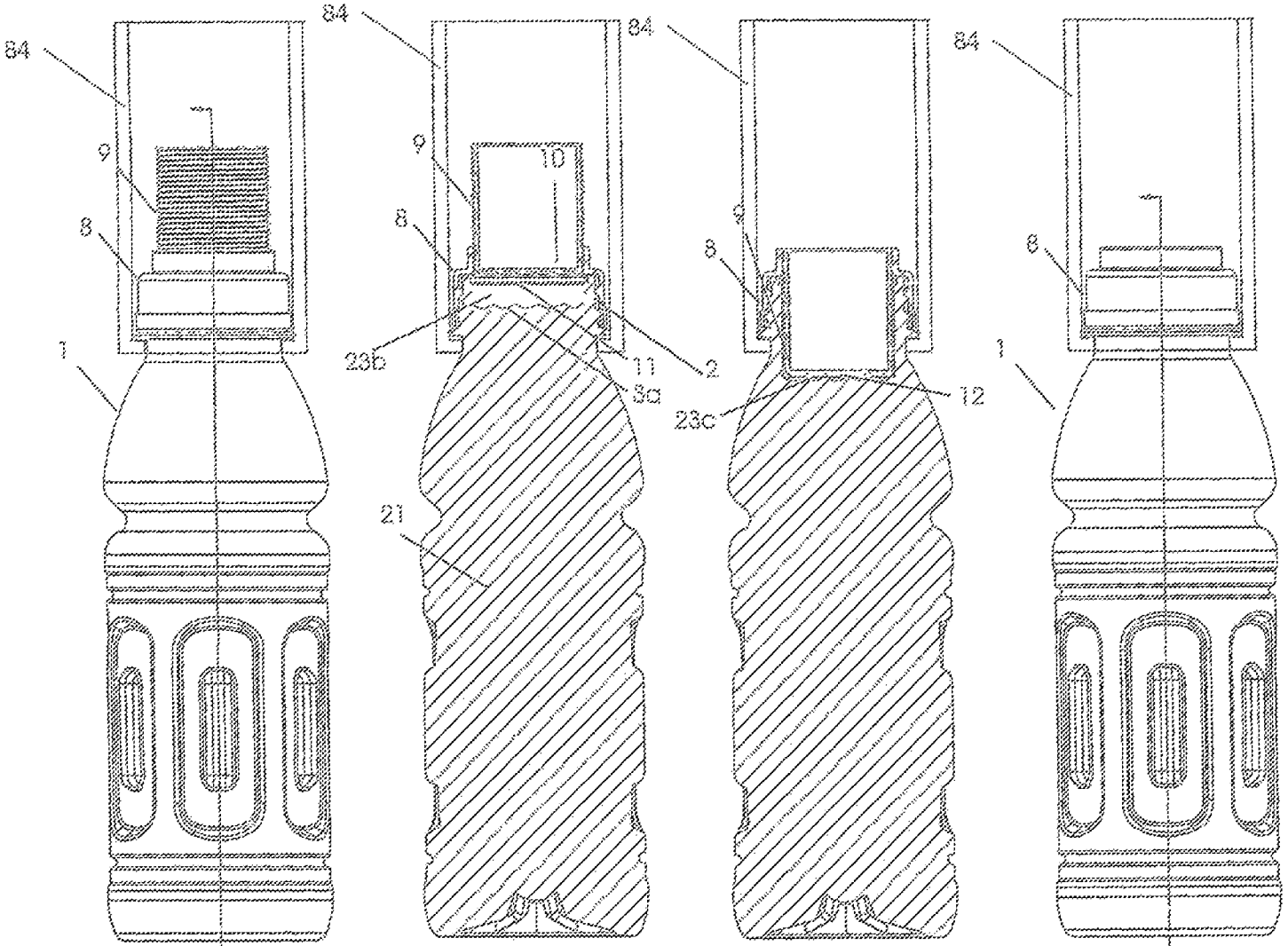
FIG. 28*a* is a side elevation view of an embodiment with a mechanically compressible cap and a sealing chamber.
FIG. 28*b* is a cross-section view FIG. 28*a;*
FIG. 28*c* is a cross-section view of FIG. 28*d;*
FIG. 28*d* is a side elevation view showing the embodiment with a compressed cap and the sealing chamber of FIG. 28*a;*

FIG. 27 shows how the sealing chamber of FIG. 26 could be incorporated into a typical capping unit station 844 with rotary head applicators. This would allow for a modified capping unit to apply a cap in the normal manner, but to modify the headspace prior to application of torque to seal the cap on the container.

In facilitating the present invention, the complete or substantial removal of vacuum pressure by displacing the headspace prior to the liquid contraction now results in being able to remove a substantial amount of weight from the sidewalls due to the removal of mechanically distorting forces.

Figure 11C:
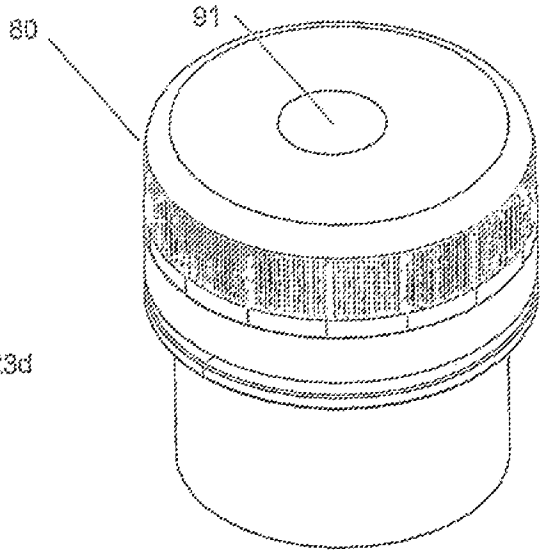
FIG. 11*c* is an upper isometric view of the assembly shown in FIG. 11*a;*
Figure 11B:
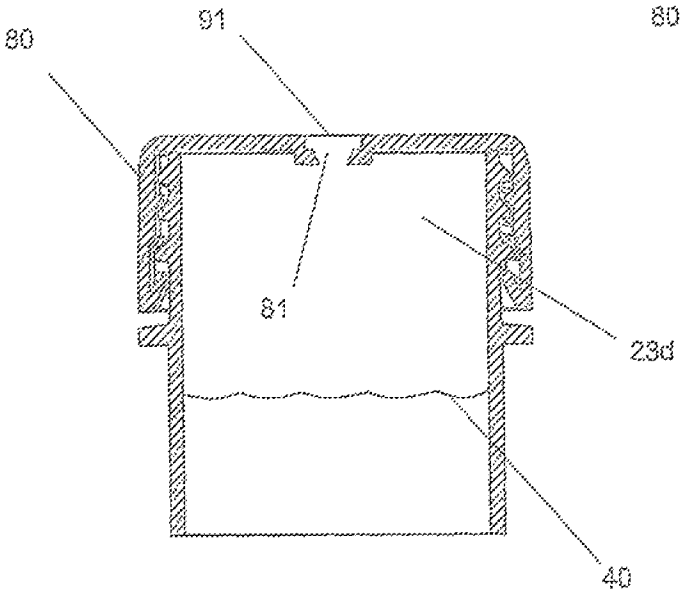
FIG. 11*b* is a cross-section of the assembly shown in FIG. 11*a;*
Figure 11A:
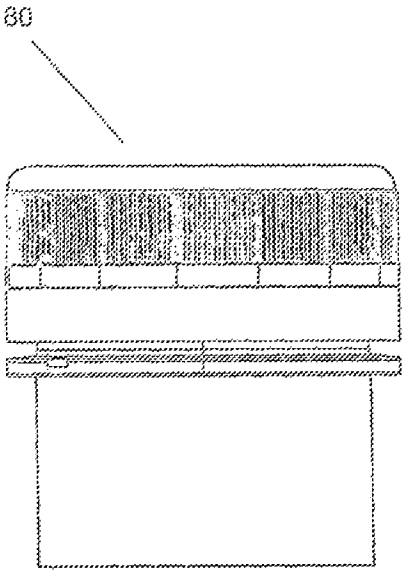
FIG. 11*a* is a side elevation view of an embodiment of the inventions in a condition in a filling line.

According to a further aspect of the present invention, and referring to FIGS. 11*a-c*, following the introduction of a liquid, which may be already heated or suitable for subsequent heating, a cap may be applied including a small opening or aperture (81) which is temporarily covered by a communicating seal (91). Thus a headspace (23*d*) is contained under the main cap body (80) and above the fluid level (40) in the container. The headspace (23*d*) is not communicating with the outside air at this stage and is therefore at typical container pressure during the stages of cooling down on the filling line.

Figure 12C:
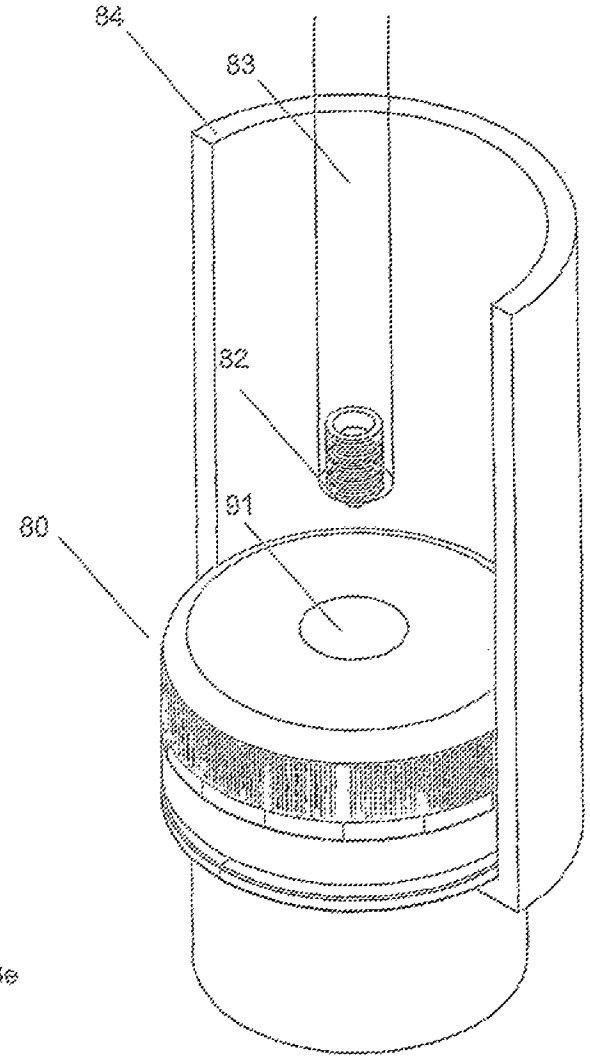
FIG. 12*c* is an upper isometric view of the assembly shown in FIG. 12*a;*
Figure 12B:
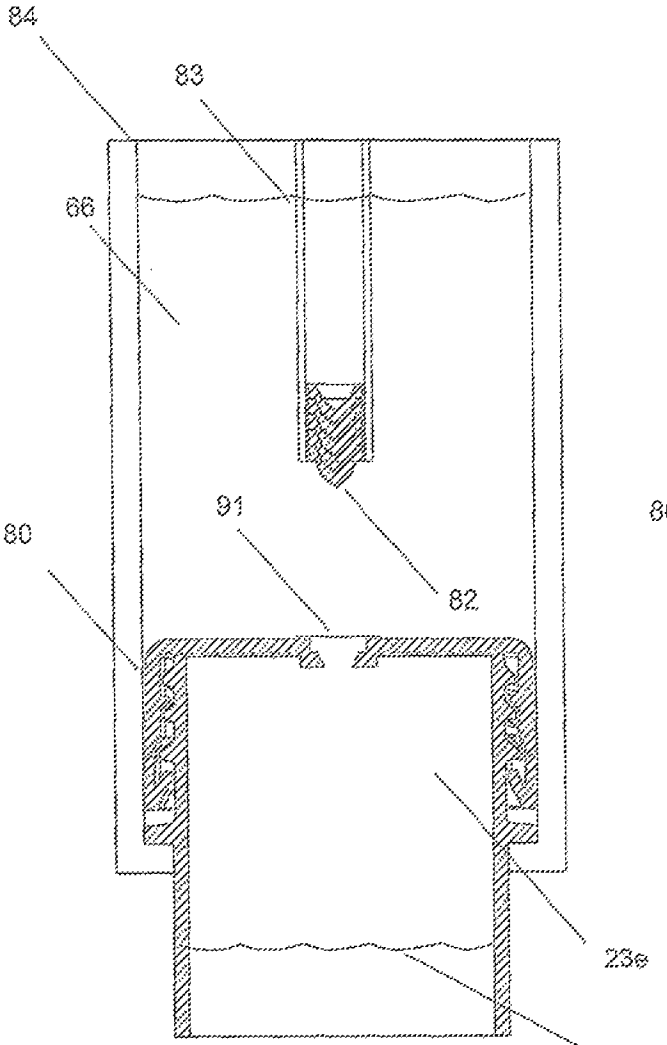
FIG. 12*b* is a cross-section of the assembly shown in FIG. 12*a;*
Figure 12A:
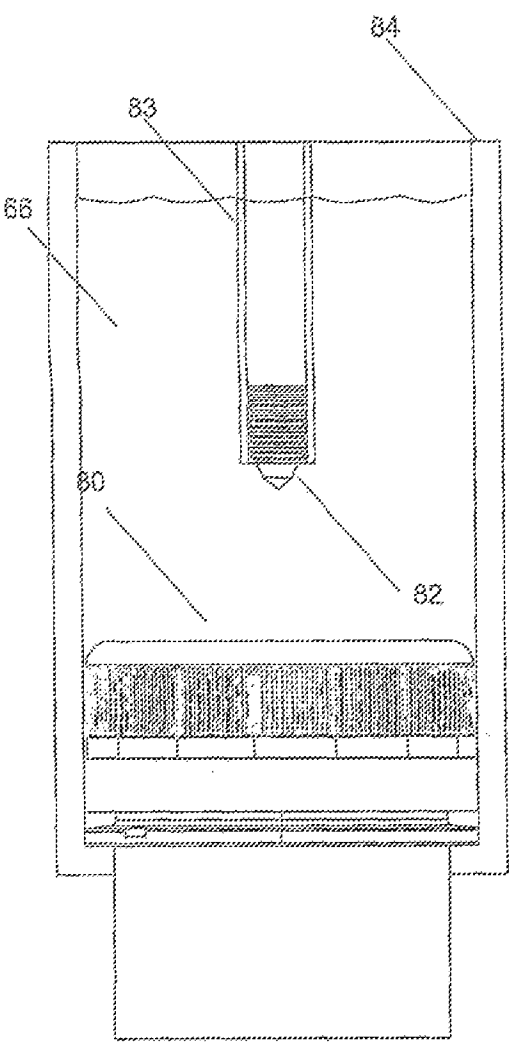
FIG. 12*a* is a schematic and side elevation view of an embodiment of the inventions in a condition such as a cooled condition.

As seen in FIGS. 12*a-c*, once the container has been typically cooled to a level providing for labelling and distribution the headspace (23*e*) will be in an expanded state with a lowered fluid level, and will have created a vacuum due to the contraction of the heated liquid within the container.

As seen in this preferred embodiment of the present invention, in order to remove the vacuum pressure a sealing chamber (84) is applied over the neck finish and cap combination to seal the communicating seal (91) from the outside air (the upper, closed end of the structure 84 is not shown).

Following the introduction of a sterilising medium (66), for example by way of injecting heated water, preferably above 95 degrees C., or a mixture of heated water and steam, the sterilising medium provides for the sterilisation of the internal surfaces of the sealing chamber (84) and the communicating seal (91).

Figure 13C:
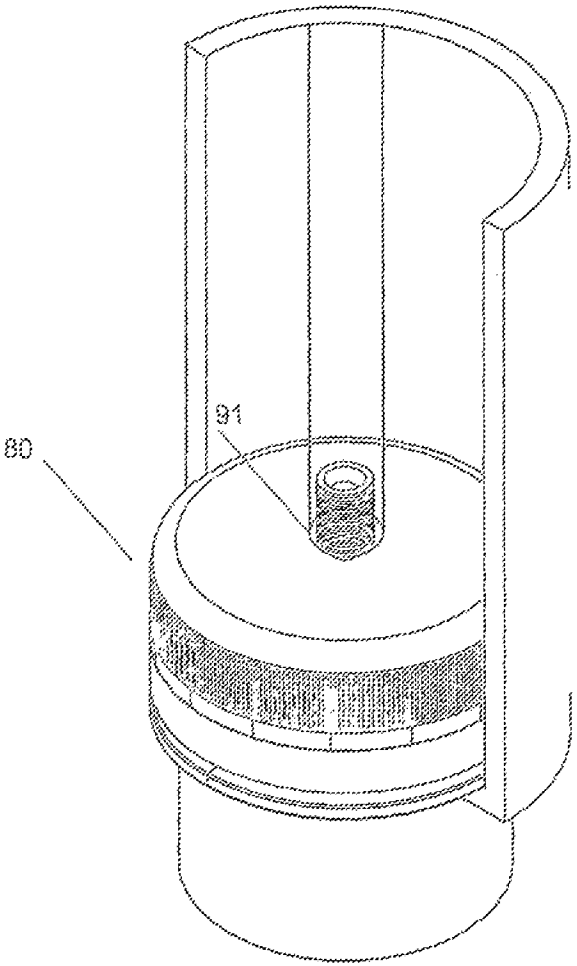
FIG. 13*c* is an upper isometric view of the assembly shown in FIG. 13*a;*
Figure 13B:
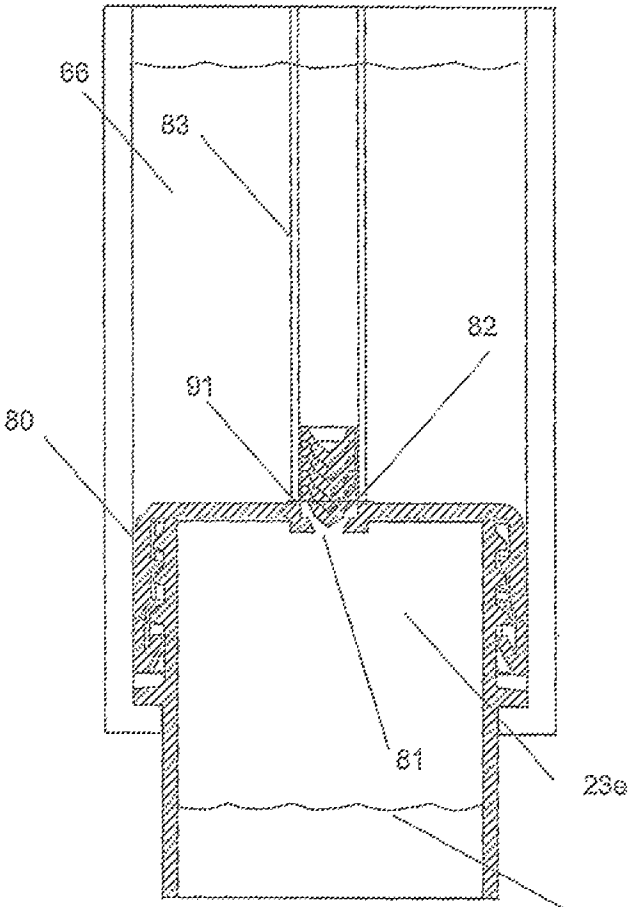
FIG. 13*b* is a cross-section of the assembly shown in FIG. 13*a;*
Figure 13A:
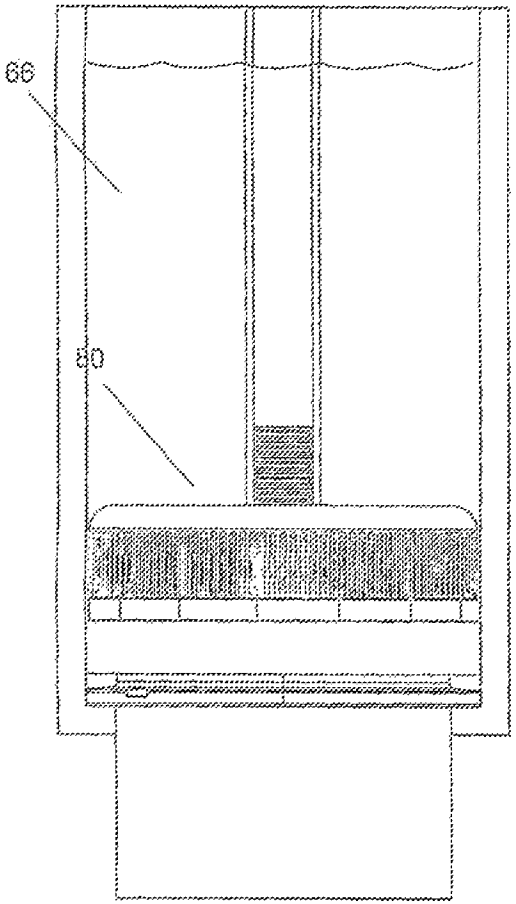
FIG. 13*a* is a schematic and side elevation view of an embodiment of the inventions in a condition such as for sterilizing.

Now referring to FIGS. 13*a-c*, while the sterilising medium is maintained within the sealing chamber (84), a plug mechanism (82) is placed downwardly from a delivery device (83) towards the aperture (81). The plug mechanism pierces the communicating seal (91) and is withdrawn again temporarily as shown in FIGS. 14*a-c*, providing for communication between the sterilized volume within the sealing chamber above the cap (80) and the headspace (23*e*) below the cap.

Figure 14C:
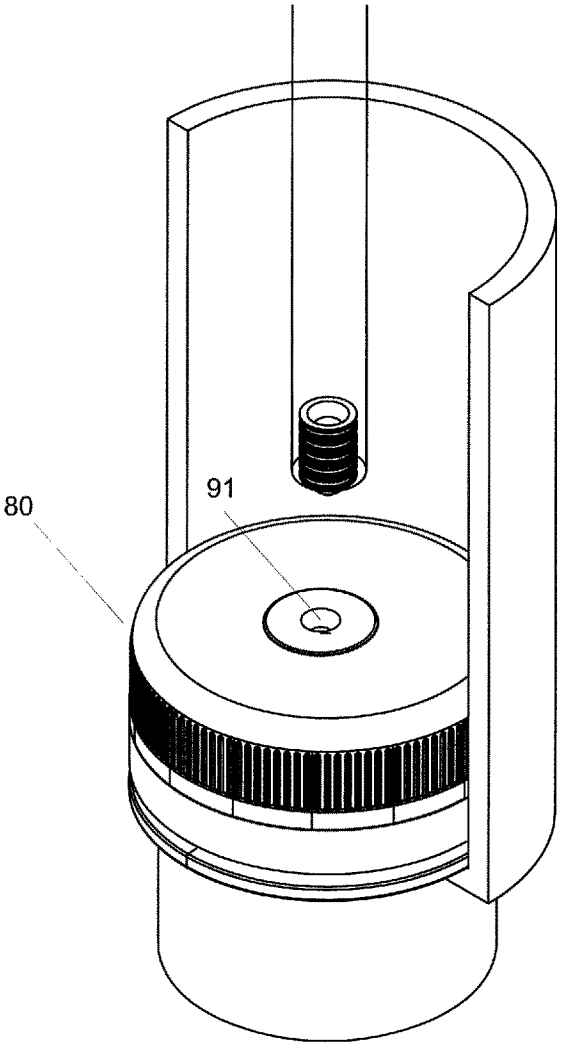
FIG. 14*c* is an upper isometric view of the assembly shown in FIG. 14*a;*
Figure 14B:
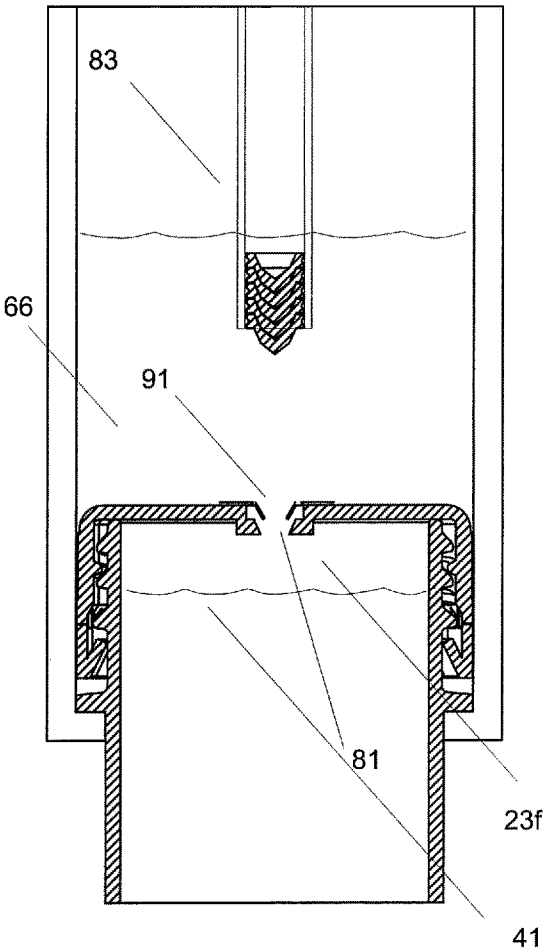
FIG. 14*b* is a cross-section of the assembly shown in FIG. 14*a;*
Figure 14A:
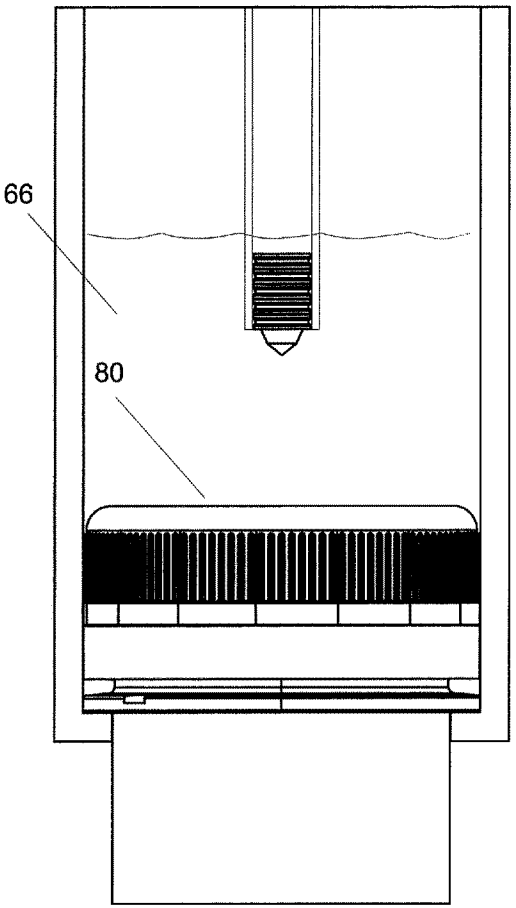
FIG. 14*a* is a schematic and side elevation view of an embodiment of the inventions in a further condition such as for sterilizing.

As can be seen in FIGS. 14*a-c*, the sterilising medium, for example heated water at 95.degree. C., is immediately drawn into the container through the open hole (81) due to the communicating seal being pierced. This causes equalization of pressure or removal of vacuum pressure within the container, such that the level of the headspace (23*f*) rises higher. In another preferred embodiment the liquid would in fact be injected into the container under a small pressure supplied from the sealing chamber (84) such that the pressure within the container would in fact be a positive pressure and the headspace would in fact be very small.

The integrity of the product volume within the container is not compromised as the environment above the cap has been sterilised prior to communicating with the headspace, and the additional liquid supplied into the container replaces the volume 'lost' due to shrinkage of heated liquid within the container prior to the method of headspace replacement described.

Figure 15C:
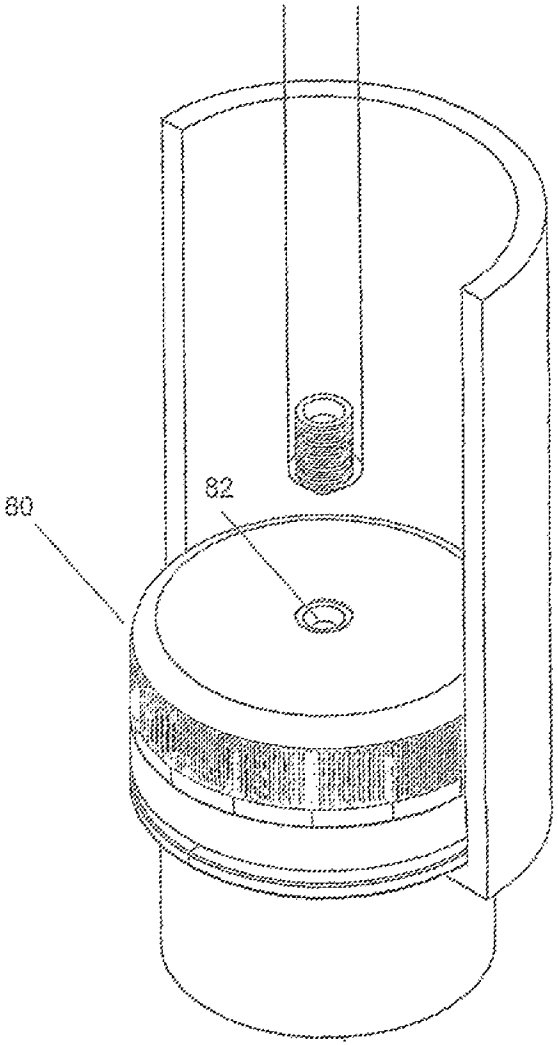
FIG. 15*c* is an upper isometric view of the assembly shown in FIG. 14*a;*
Figure 15B:
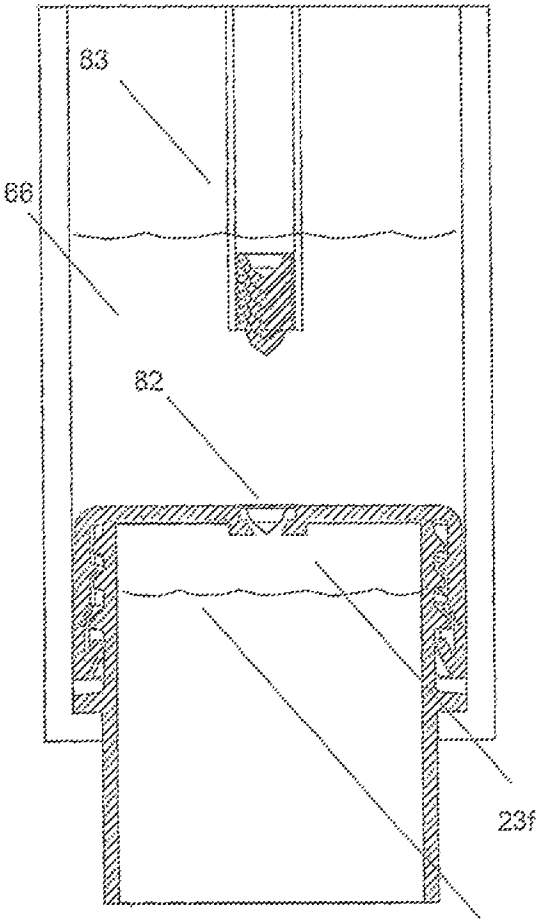
FIG. 15*b* is a cross-section of the assembly shown in FIG. 14*a;*
Figure 15A:
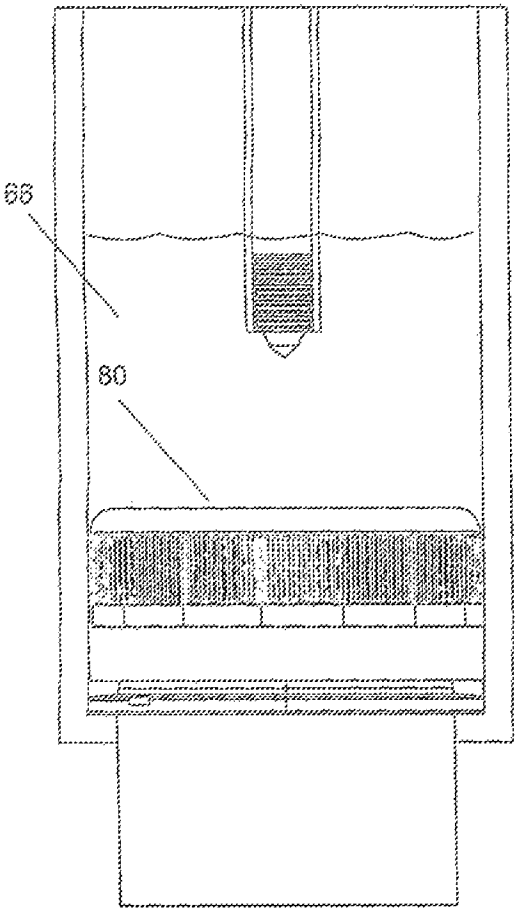
FIG. 15*a* is a schematic and side elevation view of an embodiment of the inventions in a further condition such as for sealing.

Following the pressure equalization, and now referring to FIGS. 15 *a-c*, the delivery device (83) is advanced again such that the plug (82) will be injected into the hole to close it off permanently.

At this point, the headspace (23*f*) is under a controlled pressure dependent on the volume of liquid having been delivered to compensate for previous liquid contraction, as described above.

The sealing chamber may now provide for withdrawal of the delivery device (83) which may now be done following a release of sterilising medium and/or pressure within the chamber as the container is ejected and returned to the filling line.

Figure 16C:
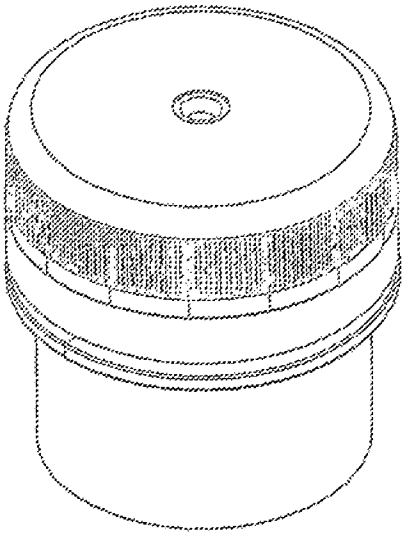
FIG. 16*c* is an upper isometric view of the assembly shown in FIG. 16*a;*
Figure 16B:
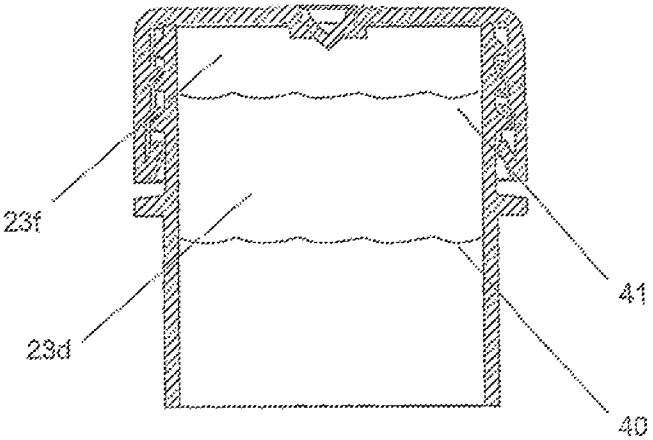
FIG. 16*b* is a cross-section of the assembly shown in FIG. 16*a;*
Figure 16A:
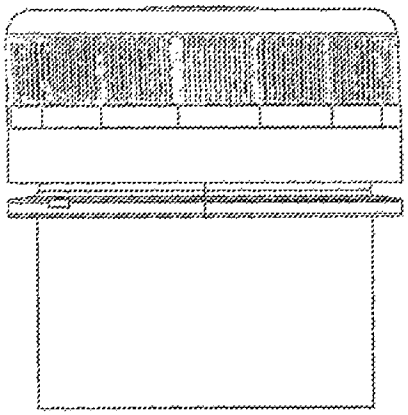
FIG. 16*a* is a side elevation view of an embodiment of the inventions in a further condition such as after cooling.

Thus a method of compensating vacuum pressure within a container is described. Referring to FIGS. 16*a-c*, the original headspace level (40) experienced following cooling of heated contents within a closed container provides for a vacuum to be present within the first headspace (23*d*). Following compensation according to this embodiment of the present invention the headspace level changes and perhaps rises (41) depending on the pressure contained within the headspace and the pressure within the headspace 23*f* is now preferably virtually at ambient pressure or preferably slightly positive such that the sidewalls of the container are supported by the slight internal pressure.

With reference to FIGS. 28*a-d*, an alternative embodiment of the present invention also incorporates a compressible cap wherein the compression occurs after filling and prior to the cooling of the contents. In this way, by compression occurring when the liquid is hot, the chamber (9) may be sterilized by the contents once it is advanced into the container. The compressible cap may be contained within a compression chamber as previously described, particularly for large size containers. Containers of the 600 ml size for example will require displacement to the order of 20-30 cc of liquid, but containers of the 2000 ml range of size will require displacement to the order of 70 cc of liquid. Such a large displacement is difficult to achieve without having an extremely large displaceable chamber entering the container. Therefore, in order to keep the chamber size to a minimum, it is envisaged that the compression chamber could provide an injection of a certain amount of gas or liquid, and a compressible cap could provide the rest of the compression required. In this way a minimum of gas is also injected into the container. Of course, for small container sizes it will be appreciated that just the compressible cap could be utilised.

Unlike as described in prior art, the present invention provides for the hot liquid within the container to sterilize the underside of the internally presented surface of the inner chamber (9) as it has been compressed into the hot liquid contents.

Ordinarily, as the product cools, a vacuum will build up within the container in the primary headspace (23*b*) under the cap. This vacuum may distort the container (1) to a degree if the walls are not rigid enough to withstand the force.

However, as the internal pressure has been adjusted upwardly prior to product cooling, the net effect may be a temporary raised level of pressure during product cooling and substantially no pressure once product cooling has finished, or perhaps even advantageously a small amount of positive pressure.

Figures 29A, 29B, 29C, 29D:
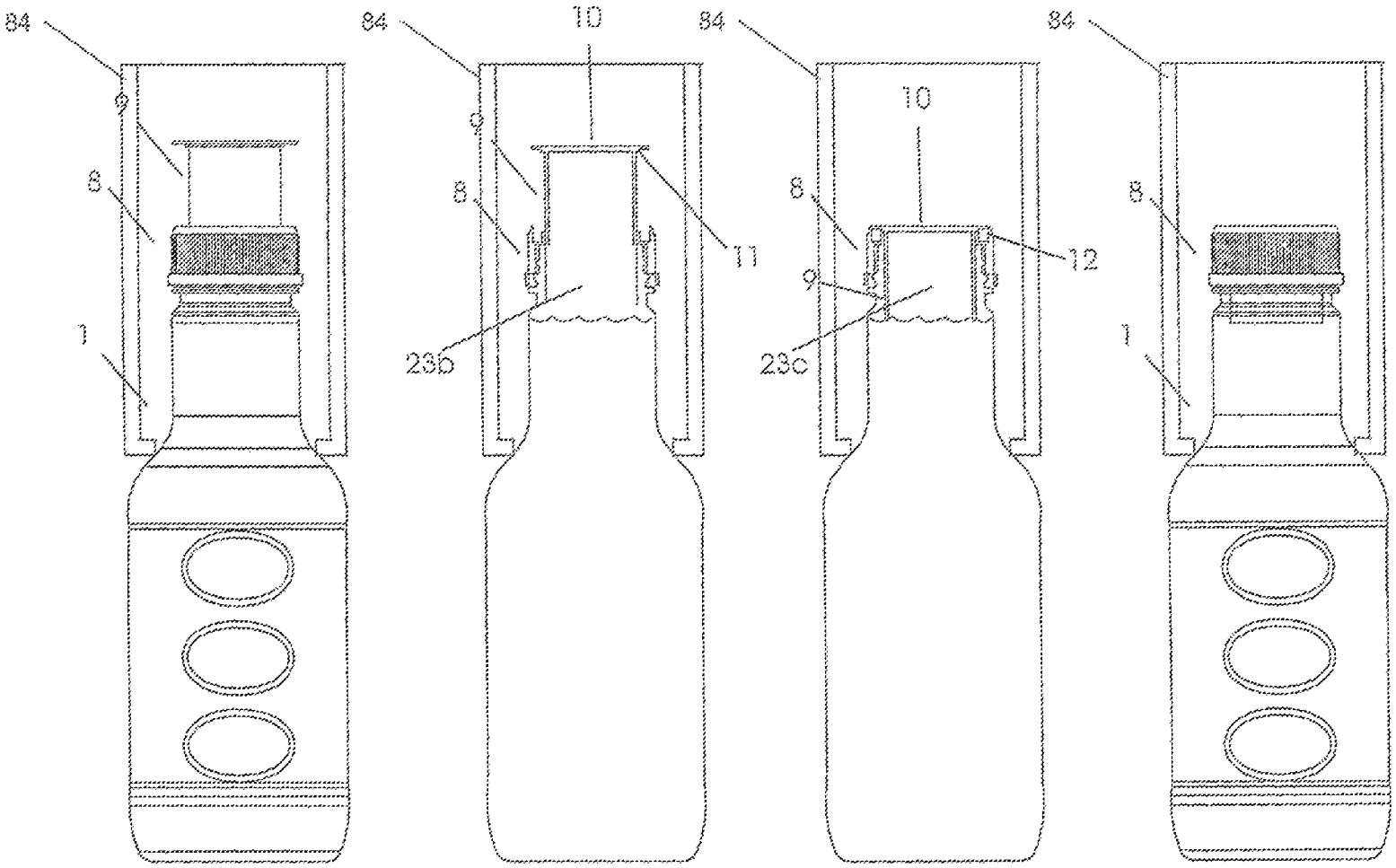
FIG. 29*a* is a side elevation view of an embodiment with a mechanically compressible cap and another sealing chamber.
FIG. 29*b* is a cross-section view FIG. 29*a;*
FIG. 29*c* is a cross-section view of FIG. 29*d;*
FIG. 29*d* is a side elevation view showing the embodiment with a compressed cap and the sealing chamber of FIG. 29*a;*

Referring to FIGS. 29 *a-d*, another similar embodiment of the present invention provides for a mechanical cap that has a mechanically controllable "out" and "in" position. The compressive cap (8) is applied to the container (1) immediately post filling with a hot beverage. In this particular embodiment the sealing surface (10) of the compressible inner chamber (9) is displaced higher than in the previous example shown in FIGS. 28 *a-d*.

Figure 30B:
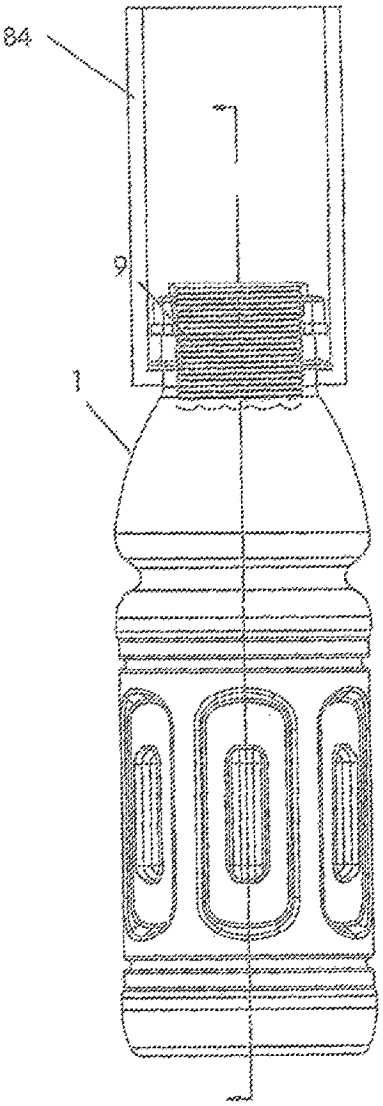
FIG. 30*b* is a cross-section view FIG. 30*a*.
Figure 30A:
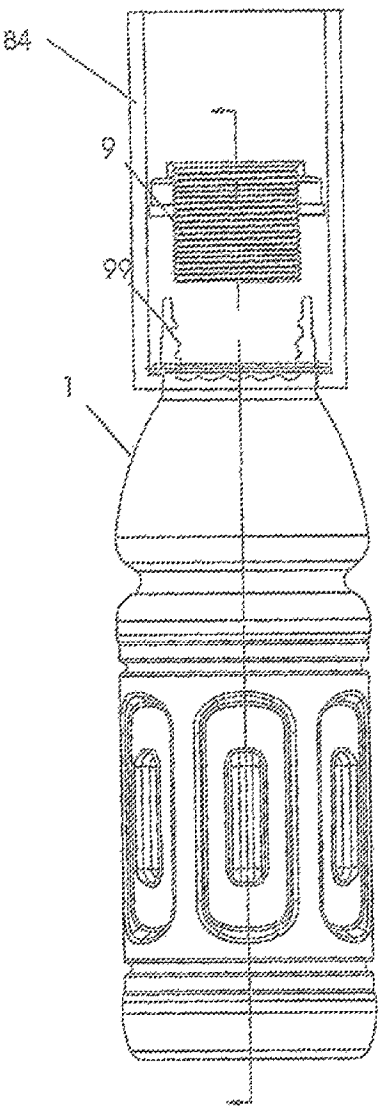
FIG. 30*a* is a side elevation view of another embodiment with a sealing chamber.

Referring to FIGS. 30 *a-b*, a further embodiment of the present invention is disclosed. The cap structure may be either a 2-piece construction, or a single unit whereby the compressible inner chamber (9) engages with an internal thread on the neck finish (99) and causes compression of the headspace as the cap is applied and secured to the container (1). Again, for larger size containers this provides the ability to keep gas or liquid injection to a minimum while utilising the displacement of the hot liquid contents to provide the increase in container pressure as the container is sealed.

Where in the foregoing description, reference has been made to specific components or integers of the invention having known equivalents then such equivalents are herein incorporated as if individually set forth.

Although this invention has been described by way of example and with reference to possible embodiments thereof, it is to be understood that modifications or improvements may be made thereto without departing from the scope of the invention as defined in the appended claims.

The invention claimed is:

1. A method of filling a container with a heated fluid including steps of:

introducing the fluid through an open end of the container so that it, at least substantially, fills an interior of the container, after the step of introducing the fluid through the open end of the container, providing a seal or cap to close and seal the filled container, cooling the heated fluid to create a first internal vacuum pressure within the headspace of the container, providing a pressurizing chamber, the pressurizing chamber being configured to enclose or contact the seal or cap of the container having the first internal vacuum pressure, wherein the pressurizing chamber comprises a pressure that is higher than the first internal vacuum pressure, after the steps of introducing the fluid through the open end of the container and providing a seal or cap to close and seal the filled container, providing or creating an opening or aperture through or around the seal or cap of the filled and sealed container into the interior of the container, providing at least one fluid through the opening or aperture;

and sealing the opening or aperture under a second internal increased pressure higher than the first internal vacuum pressure so as to compensate for the pressure reduction in the headspace of the container under the seal or cap following the cooling of the heated fluid, wherein when the seal or cap is provided to close and seal the filled container, there is an initial sealing pressure within the container, the initial sealing pressure being greater than the first internal vacuum pressure that results from the step of cooling the heated fluid; and the step of sealing the opening or aperture causes the container to be sealed for a second time.

2. A method as claimed in claim 1 in which the at least one fluid passes through the opening or aperture under pressure.

3. A method as claimed in claim 2 in which the container is positioned in a sterilizing means and the fluid is a heated liquid injected through the opening or aperture.

4. The method of claim 1 wherein the pressurizing chamber contains a device for sealing the opening into the container, the chamber is positioned over said opening onto the interior of the container, pressurizing the interior of the container with a volume of gas, or vapour, or liquid or combination thereof, moving the device for sealing said opening within the pressurizing chamber relative to the open end of the container to close the open end and seal the gas, or vapour, or liquid or combination thereof within the container while maintaining the second internal pressure within the container, and releasing the closed container from the chamber.

5. The method of claim 4 including providing for a sealed connection between the pressurizing chamber and the interior of the container.

6. The method of claim 5 in which positive pressure is maintained in the container prior to its release from the pressurizing chamber.

7. The method of claim 6 in which the positive pressure does not increase in the container following its release from the pressurizing chamber.

8. The method of claim 5, wherein the pressure within the pressurizing chamber is released prior to releasing the closed container from the pressurizing chamber.

9. The method of claim 8, wherein the step of moving the device for sealing comprises vertically moving a seal to engage with the open end of the container.

10. The method of claim 5, wherein the step of providing a seal or cap comprises rotating a cap onto a neck finish of the container.

11. The method of claim 1, further including the step of moving the container toward the pressurizing chamber.

12. The method of claim 1, wherein the pressurizing chamber is sealed against the seal or cap prior to pressurization of the pressurizing chamber.

13. The method of claim 1, wherein the opening is created in the seal or cap when within the pressurizing chamber.

14. The method of claim 1, wherein the container is positioned in a sterilizing means to sterilize the cap or seal.

15. The method of claim 14, wherein the sterilizing means is provided within the pressurizing chamber.

16. The method of claim 15 including heating the fluid before or after its introduction into the container.

17. A method of filling a container with a heated fluid including steps of:

introducing the fluid through an open end of the container so that it, at least substantially, fills an interior of the container, after the step of introducing the fluid through the open end of the container, providing a seal or cap to close and seal the container, cooling the heated fluid to create a first internal vacuum pressure within the headspace of the filled and sealed container, providing a pressurizing means, the pressurizing means being configured to enclose or contact the seal or cap of the filled and sealed container having the first internal vacuum pressure, wherein the pressurizing means comprises a pressure that is higher than the first internal vacuum pressure, after the steps of introducing the fluid through the open end of the container and providing a seal or cap to close and seal the filled container, creating or providing an opening or aperture through or around the seal or cap of the filled and closed container into the interior of the container, providing at least one fluid through the opening or aperture;

and sealing the opening or aperture under a second internal increased pressure higher than the first internal vacuum pressure so as to compensate for the pressure reduction in the headspace of the container under the seal or cap following the cooling of the heated fluid, wherein when the seal or cap is provided to close and seal the filled container, there is an initial sealing pressure within the container, the initial sealing pressure being greater than the first internal vacuum pressure that results from the step of cooling the heated fluid; and the step of sealing the opening or aperture causes the container to be sealed for a second time.

* * * * *